US010974109B2

(12) United States Patent
Stokke et al.

(10) Patent No.: US 10,974,109 B2
(45) Date of Patent: Apr. 13, 2021

(54) GOLF CLUB WITH ADJUSTABLE WEIGHTING SYSTEM

(71) Applicant: KARSTEN MANUFACTURING CORPORATION, Phoenix, AZ (US)

(72) Inventors: Ryan Stokke, Anthem, AZ (US); David Higdon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/723,307

(22) Filed: Dec. 20, 2019

(65) Prior Publication Data

US 2020/0197769 A1 Jun. 25, 2020

Related U.S. Application Data

(60) Provisional application No. 62/855,751, filed on May 31, 2019, provisional application No. 62/784,190, filed on Dec. 21, 2018.

(51) Int. Cl.

| | |
|---|---|
| ***A63B 53/04*** | (2015.01) |
| ***A63B 53/06*** | (2015.01) |
| ***A63B 53/08*** | (2015.01) |

(52) U.S. Cl.

CPC ..... *A63B 53/08* (2013.01); *A63B 53/0412* (2020.08); *A63B 53/0437* (2020.08); *A63B 53/0466* (2013.01); *A63B 53/06* (2013.01); *A63B 2053/0491* (2013.01)

(58) Field of Classification Search

CPC ..... A63B 2053/0491; A63B 53/0466; A63B 53/06

USPC ..... 473/334, 335

See application file for complete search history.

(56) References Cited

U.S. PATENT DOCUMENTS

| | | | | |
|---|---|---|---|---|
| 5,518,243 | A | 5/1996 | Redman | |
| 5,947,840 | A * | 9/1999 | Ryan | A63B 53/04 473/335 |
| 8,197,357 | B1 * | 6/2012 | Rice | A63B 53/04 473/334 |
| 8,435,135 | B2 | 5/2013 | Stites | |
| 9,623,294 | B1 | 4/2017 | Kingston | |

(Continued)

FOREIGN PATENT DOCUMENTS

| | | |
|---|---|---|
| CN | 1778426 | 5/2006 |
| GB | 2327889 | 2/1999 |

(Continued)

OTHER PUBLICATIONS

Callaway Promises Epic Ball Speed (again) With Epic Flash Drivers and Ai-driven Face Technology:https://mygolfspy.com/2019-callaway-epic-flash-epic-flash-subzero-driver/Jan. 10, 2019.

(Continued)

*Primary Examiner* — John E Simms, Jr.

(57) ABSTRACT

A golf club head having an adjustable weight system. The golf club head having a single, relatively compact slot for receiving a weight assembly. The weight assembly comprising a relatively high mass. Wherein small lateral movements of the heavy weight assembly are sufficient to shape a golfer's shot. Wherein the small movements also prevents the reduction of the total golf club head moment of inertia, thus preserving the forgiveness of the golf club when the ball is miss-hit.

18 Claims, 13 Drawing Sheets

(56) References Cited

U.S. PATENT DOCUMENTS

| | | | | |
|---|---|---|---|---|
| 9,968,833 | B2 | 5/2018 | Breier | |
| 2003/0232659 | A1* | 12/2003 | Mahaffey | A63B 60/02 473/256 |
| 2006/0172821 | A1 | 8/2006 | Evans | |
| 2006/0178228 | A1* | 8/2006 | DiMarco | A63B 60/02 473/334 |
| 2008/0020861 | A1 | 1/2008 | Adams | |
| 2008/0194354 | A1* | 8/2008 | Nagai | A63B 60/02 473/334 |
| 2009/0203465 | A1* | 8/2009 | Stites | A63B 53/04 473/343 |
| 2011/0009209 | A1* | 1/2011 | Llewellyn | A63B 53/04 473/336 |
| 2011/0039634 | A1* | 2/2011 | Tavares | A63B 60/00 473/335 |
| 2012/0083359 | A1 | 4/2012 | Stites | |
| 2012/0329571 | A1 | 12/2012 | Stites | |
| 2013/0040755 | A1* | 2/2013 | Stites | A63B 53/04 473/334 |
| 2017/0173413 | A1 | 6/2017 | Cleghorn | |
| 2017/0182384 | A1 | 6/2017 | Parsons | |
| 2018/0056154 | A1* | 3/2018 | Wallin | A63B 53/04 |
| 2018/0318672 | A1 | 11/2018 | Sargent | |

FOREIGN PATENT DOCUMENTS

| | | |
|---|---|---|
| WO | 2018005876 | 1/2018 |
| WO | 2020132512 | 6/2020 |

OTHER PUBLICATIONS

Taylormade Sldr Driver Offers Most Advanced Adjustablity:https://www.golfchannel.com/article/eguipment-insider/taylormade-sldr-driver-offers-most-advanced-adjustablity\Date Accessed: Jan. 10, 2019.

ISR and WO for PCT/US2019/067964 published Mar. 19, 2020.

* cited by examiner

GOLF CLUB WITH ADJUSTABLE WEIGHTING SYSTEM

RELATED APPLICATIONS

This claims benefit of Provisional Application No. U.S. 62/784,190 filed Dec. 21, 2018, and Provisional Application No. U.S.62/855,751 filed May 31, 2019, which are incorporated herein in their entirety.

TECHNICAL FIELD

This disclosure relates generally to a golf club head with an adjustable weight wherein the weight system provides peripheral weighting and trajectory manipulation of the golf ball flight upon impact.

BACKGROUND

In general, there are many important physical parameters (i.e., volume, mass, etc.) that effect the overall performance of the golf club head. One of the most important physical parameters is the center of gravity (CG) of the golf club head. The CG of the golf club head directly affects the performance characteristics (i.e., moment of inertia, launch, ball speed, etc.). A desirable CG position on a golf club head is low and rearward from the strike face, to optimally raise the launch angle and MOI of the golf ball. Additionally, the CG position can be moved nearer to the toe end or heel end of the golf club head to further affect the side spin of the golf ball.

Many current wood type golf club heads achieve a desired CG position through the use of slidable swing weights on the sole of the golf club head, or through the use of multiple swing weight ports, wherein one or more weights can be affixed within. However, slidable swing weights and multiple weight configurations require a large amount of internal structure to support the plurality of weights and/or the different positioning of the weight(s). Further, these bulky weight systems can negatively affect the CG positioning since discretionary mass of the club head is allotted to support the weight systems. There is a need in the art for a weighting system that can variably affect the CG of the golf club head, without the need for a slidable system or plurality of weight ports.

Moving the center of gravity of a golf club head toward the heel or toe of the golf club head contributes to shaping golf ball flight towards a fade or draw bias. Such shot shaping is desirable to help improve a golfer's shot. However, if an adjustable weight system requires a comparatively large movement of the adjustable weight across the volume of the golf club head, then the CG of the golf club head is moved forward toward the striking face of the golf club head, and usually moved higher above the sole in the volume of the golf club head. This movement of the CG towards the striking face and higher in the club head volume reduces the combined moment of inertia of the golf club head. The reduction of club head MOI is not desirable, as the forgiveness for off center hits is reduced. Thus, in conventional adjustable weight systems, the user must choose between shot shaping and forgiveness. Further, in conventional adjustable weight systems, the larger or more distributed weight port structures are permanently placed masses that often offset the effect of the movement of an adjustable weight member to other positions on a golf club head

BRIEF DESCRIPTION OF THE DRAWINGS

This disclosure relates generally to sport equipment and relates more particularly to golf club heads and related methods.

Figure 1:
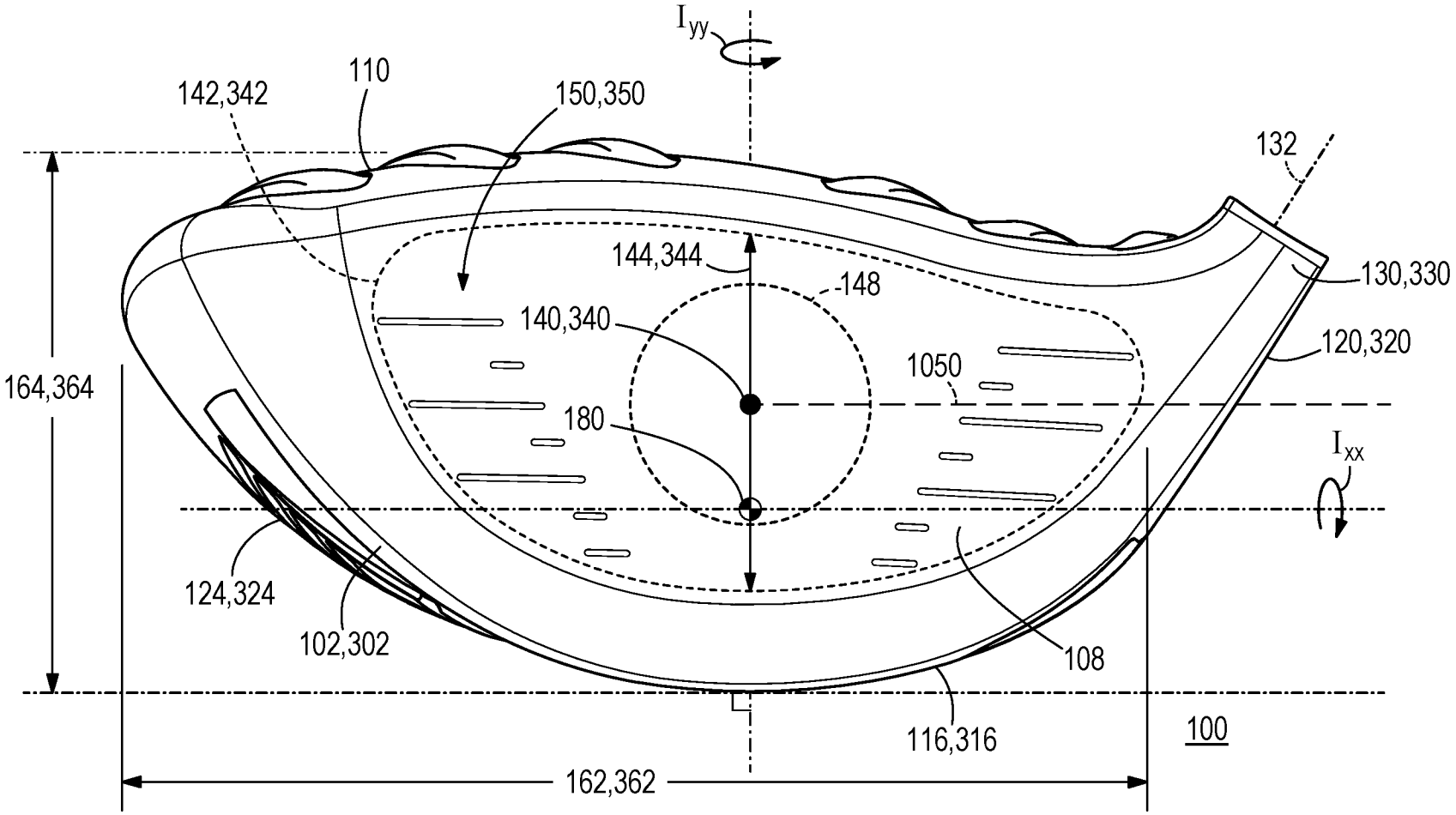
FIG. 1 illustrates a front view of a golf club head.

Other aspects of the disclosure will become apparent by consideration of the detailed description and accompanying drawings.

DESCRIPTION

Described herein is a golf club head having an adjustable weight assembly. The golf club head comprises a heavy, large mass weight member mechanically fixed within a slot on the sole of the golf club head. The slot is located at the farthest rear point of the golf club head and is confined to a comparably small arc at the rear portion of the golf club head. The positioning of the adjustable weight assembly, the large mass of the weight member, and the small arc of movement of the weight member combine to address an ongoing problem associated with adjustable weight systems for golf club heads.

In conventional adjustable weight systems, a large movement of the adjustable weight is needed to affect ball flight, because the mass of the weight moved is relatively small. However, the large movement of the weight mass also cause relatively large decreases in the total moment of inertia of the golf club head. Thus, in a conventional adjustable weight system the user is forced to accept a decrease in forgiveness for miss-hits in order to achieve shot shaping.

The weight assembly slot described herein comprises two to six threaded receivers positioned relatively close to one another. The weight member can be positioned in two to six positions within the slot, to influence a straight ball flight, a right to left ball flight, and a left to right ball flight. The combination of a single, smaller slot on the sole with a single, heavy weight member leads to improvements in CG movement and MOI preservation. This is achieved by confining the slot to a relatively small arc on the rear of the golf club head. The smaller arc provided a smaller displacement towards the heel or toe of the golf club head, but the heavier weight counter balances the smaller displacement of the weight member, allowing the user to shape golf ball flight by using a comparatively smaller weight member displacement.

In addition, the discretionary mass that is saved from only having a single, smaller weight slot can be allocated to favorable locations to further improve the CG and MOI of the golf club head. The weight member configuration allows improvements in heel and toe movement of the CG without grossly affecting the overall CG and total inertia of the golf club head. Furthermore, the weight member and slot combination improves the heel and toe movement of the CG, without physically reallocating the mass of the golf club head to completely different portions of the golf club head. Thus, the weight member configuration allows the user to change the shot shape of the golf club head, without effecting the overall inertia and launch of the golf club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

I) Golf Club Head—Introduction

The golf club head 100, 300 comprises a hosel 130, a strike face 108, a crown 110, a sole 116, a heel region 120, a toe region 124, and a rear portion 128. Together, the strike face 108, the crown 110, the sole 116, the heel region 120, the toe region 124, and the rear portion 128 form a hollow interior of the club head 100. The golf club head 100 further comprises a slot 240 in the rear portion 128 and the sole 116. A weight assembly 380 can be positioned and affixed within the slot 240.

Referring to FIG. 1, the strikeface 108 of the club head 100 defines a geometric center 140, 340. In some embodiments, the geometric center 140, 340 can be located at the geometric centerpoint of a strikeface perimeter 142, and at a midpoint of face height 144. In the same or other examples, the geometric center 140, 340 also can be centered with respect to engineered impact zone 148, which can be defined by a region of grooves 150 on the strikeface. As another approach, the geometric center 140, 340 of the strikeface 108 can be located in accordance with the definition of a golf governing body such as the United States Golf Association (USGA). For example, the geometric center 140, 340 of the strikeface 108 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

A) Golf Club Head Coordinate System

Referring to FIG. 1, the club head 100 further defines a loft plane 1010 tangent to the geometric center 140, 340 of the strikeface 108. The face height 144 can be measured parallel to loft plane 1010 between a top end of the strikeface perimeter 142 near the crown 110 and a bottom end of the strikeface perimeter 142 near the sole 116. In these embodiments, the strikeface perimeter 142 can be located along the outer edge of the strikeface 108 where the curvature deviates from the bulge and/or roll of the strikeface 108.

Figure 2:
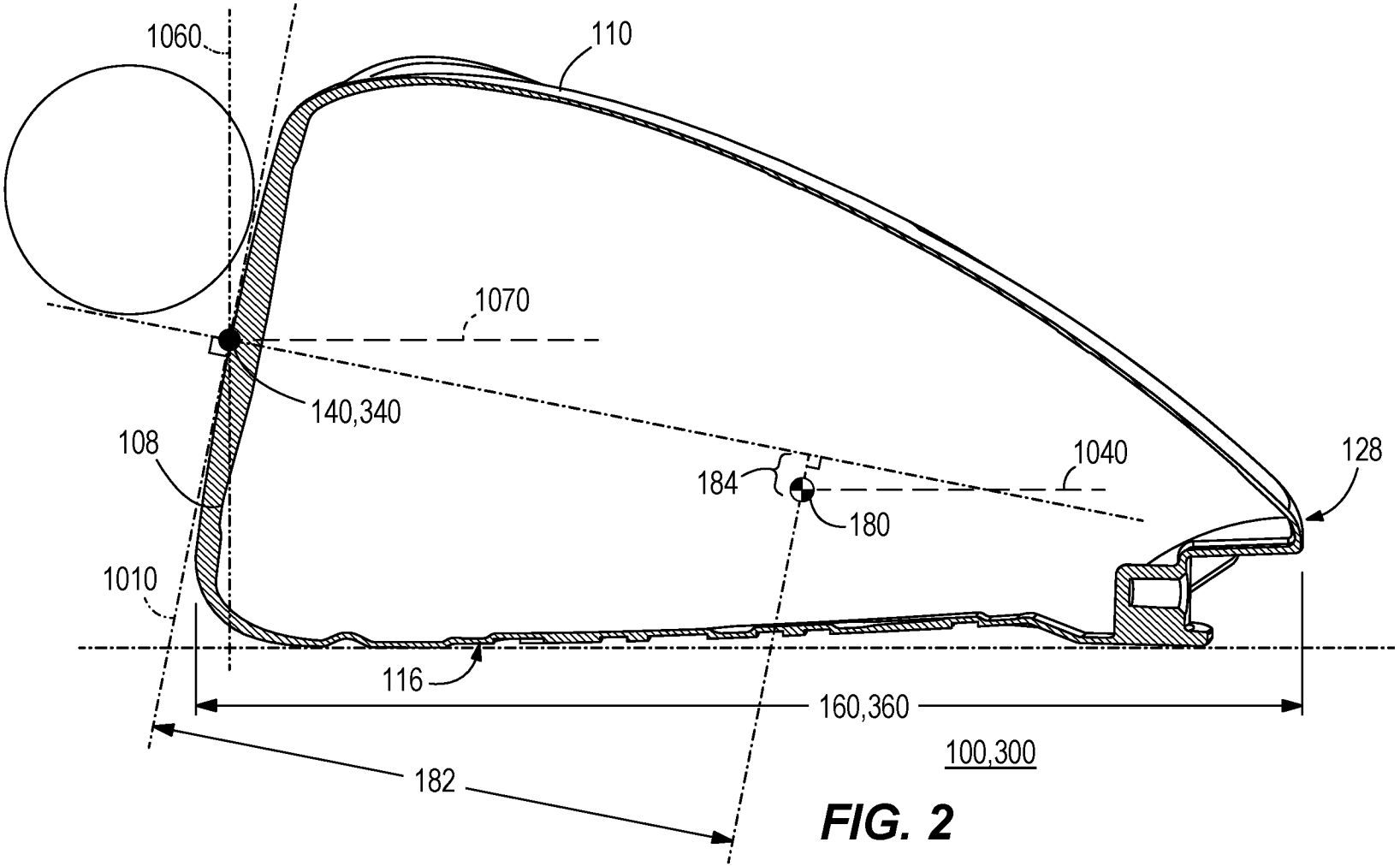
FIG. 2 illustrates a side cross-section a golf club head.

Referring to FIGS. 1 and 2, the geometric center 140, 340 of the strikeface 108 further defines a coordinate system having an origin located at the geometric center 140, 340 of the strikeface 108, the coordinate system having an X axis 1050, a Y axis 1060, and a Z axis 1070. The X axis 1050 extends through the geometric center 140, 340 of the strikeface 108 in a direction from the heel 120 to the toe 124 of the club head 100. The Y axis 1060 extends through the geometric center 140, 340 of the strikeface 108 in a direction from the crown 110 to the sole 116 of the club head 100 and perpendicular to the X axis 1050, and the Z axis 1070 extends through the geometric center 140 of the strikeface 108 in a direction from the front end 112, 312 to the back end 114 of the club head 100 and perpendicular to the X axis 1050 and the Y axis 1060.

Referring to FIGS. 1 and 2, the coordinate system defines an XY plane extending through the X axis 1050 and the Y axis 1060, an XZ plane extending through the X axis 1050 and the Z axis 1070, and a YZ plane extending through the Y axis 1060 and the Z axis 1070, wherein the XY plane, the XZ plane, and the YZ plane are all perpendicular to one another and intersect at the origin of the coordinate system located at the geometric center 140, 340 of the strikeface 108. The XY plane extends parallel to the hosel axis 132 and is positioned at an angle corresponding to the loft angle of the club head 100 from the loft plane 1010. Further the X axis 1050 is positioned at a 60 degree angle to the hosel axis 132 when viewed from a direction perpendicular to the XY plane.

In these or other embodiments, the club head 100 can be viewed from a front view (FIG. 1) when the strikeface 108 is viewed from a direction perpendicular to the XY plane. Further, in these or other embodiments, the club head 100 can be viewed from a side view or side cross-sectional view (FIG. 2) when the heel 120 is viewed from a direction perpendicular to the YZ plane.

Figure 3:
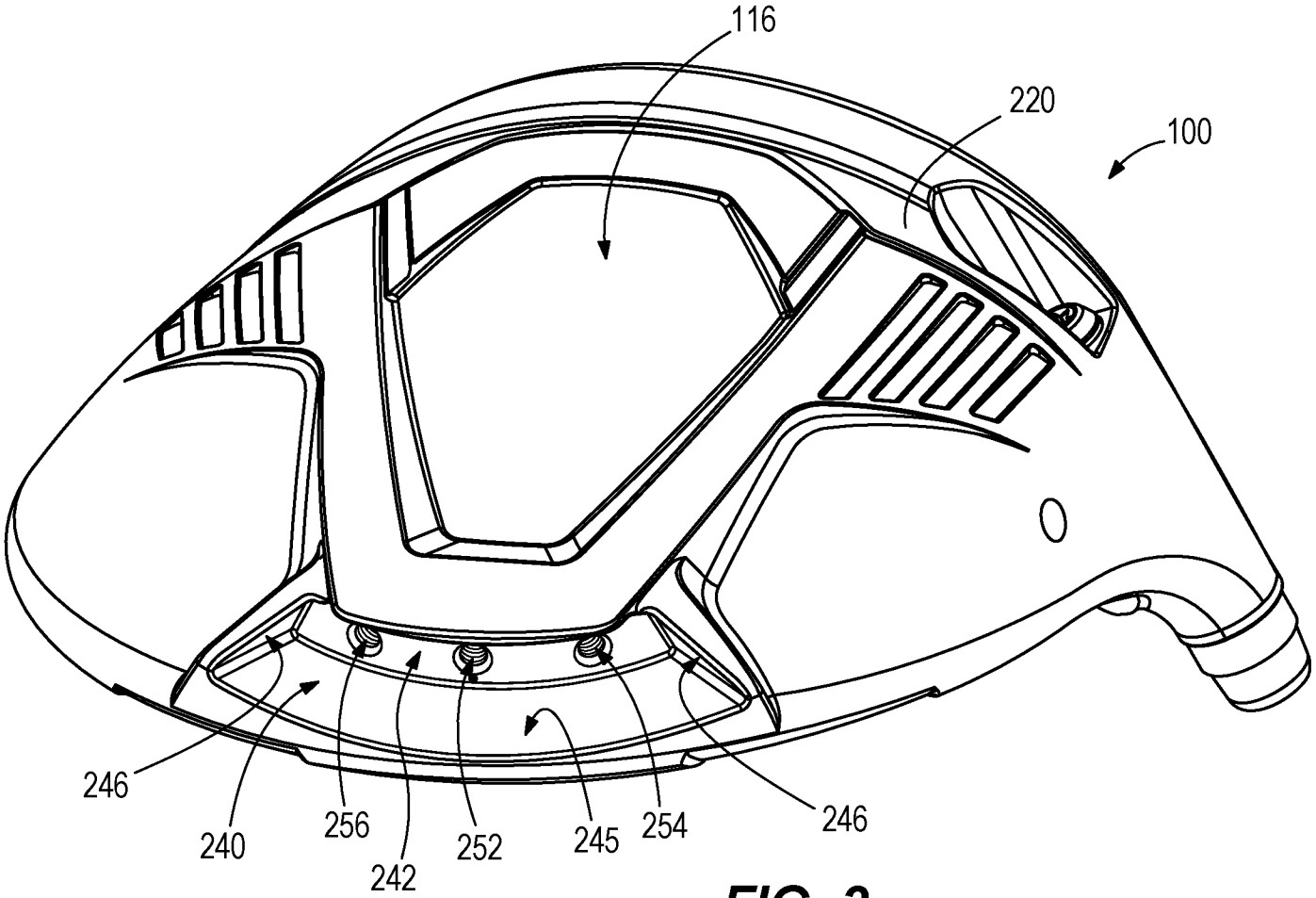
FIG. 3 illustrates a rear sole view of a golf club head.

The club head 100, 300 defines a depth 160, 360, a length 162, 362, and a height 164, 364. Referring to FIG. 3, the depth 160, 360 of the club head can be measured as the furthest extent of the club head 100, 300 from the front end 112, 312, to the back end 114, in a direction parallel to the Z axis 1070.

The length 162 of the club head 100 can be measured as the furthest extent of the club head 100 from the heel 120 to the toe 124, in a direction parallel to the X axis 1050, when viewed from the front view (FIG. 1). In many embodiments, the length 162 of the club head 100 can be measured according to a golf governing body such as the United States Golf Association (USGA). For example, the length 162 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

The height 164 of the club head 100 can be measured as the furthest extent of the club head 100 from the crown 110 to the sole 116, in a direction parallel to the Y axis 1060, when viewed from the front view (FIG. 1). In many embodiments, the height 164 of the club head 100 can be measured according to a golf governing body such as the United States Golf Association (USGA). For example, the height 164 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-the-club-head-size-of-wood-clubs.pdf) (the "Procedure for Measuring the Club Head Size of Wood Clubs").

Referring to FIGS. 1 and 2, the club head 100 further comprises a head center of gravity (CG) 180 and a head depth plane 1040 extending through the geometric center 140, 340 of the strikeface 108, perpendicular to the loft plane 1010, in a direction from the heel 120 to the toe 124 of the club head 100. In many embodiments, the head CG 180 is located at a head CG depth 182 from the XY plane, measured in a direction perpendicular to the XY plane. In some embodiments, the head CG 180 can be located at a head CG depth 182 from the loft plane 1010, measured in a direction perpendicular to the loft plane. The head CG 180 is further located at a head CG height 184 from the head depth plane 1040, measured in a direction perpendicular to the head depth plane 1040. Further, the head CG height 184 is measured as the offset distance from the head depth plane 1040 in a direction perpendicular to the head depth plane 1040 toward the crown 110 or toward the sole 116. In many embodiments, the head CG height 184 is positive when the head CG is located above the head depth plane 1040 (i.e. between the head depth plane 1040 and the crown 110), and the head CG height 184 is negative with the head CG is located below the head depth plane 1040 (i.e. between the head depth plane 1040 and the sole 116). In some embodiments, the absolute value of the head CG height 184 can describe a head CG 180 positioned above or below the head depth plane 1040 (i.e. between the head depth plane 1040 and the crown 110 or between the head depth plane 1040 and the sole 116). In many embodiments, the head CG 180 is strategically positioned toward the sole 116 and back end 114 of the club head 100 based on various club head parameters, such as volume and loft angle, as described below. Further, in many embodiments, the head CG 180 is strategically positioned toward the sole 116 and back end 114 of the club head 100 in combination with reduced aerodynamic drag.

The club head 100 can further comprises a moment of inertia $I_{xx}$ (i.e. crown-to-sole moment of inertia) about an axis parallel to the X axis through the club head CG 180, a moment of inertia $I_{yy}$ (i.e. heel-to-toe moment of inertia) about an axis parallel to the Y axis through the club head CG 180, and a moment of inertia $I_{zz}$ about an axis parallel to the Z axis through the club head CG 180. The sum of Ixx, Iyy, and Izz is the total or combined moment of inertia of the golf club head 100. In many embodiments, the crown-to-sole moment of inertia $I_{xx}$ and the heel-to-toe moment of inertia $I_{yy}$ are increased or maximized based on various club head parameters, such as volume and loft angle, as described in further detail below. Further, in many embodiments, the crown-to-sole moment of inertia $I_{xx}$ and the heel-to-toe moment of inertia $I_{yy}$ are increased or maximized in combination with reduced aerodynamic drag.

Described herein are various embodiments of a golf club head 100 having a movable weight assembly 380. In many embodiments, the golf club head 100 can be wood type golf club head (i.e. driver, fairway wood, hybrid).

B) Driver

In some embodiments, the golf club head 100 can comprise a driver. In these embodiments, the loft angle of the club head can be less than approximately 16 degrees, less than approximately 15 degrees, less than approximately 14 degrees, less than approximately 13 degrees, less than approximately 12 degrees, less than approximately 11 degrees, or less than approximately 10 degrees. Further, in these embodiments, the volume of the club head can be greater than approximately 400 cc, greater than approximately 425 cc, greater than approximately 450 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the club head can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

C) Fairway Wood

In some embodiments, the golf club head can comprise a fairway wood. In these embodiments, the loft angle of the golf club head can be less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the club head can be between 12 degrees and 35 degrees, between 15 degrees and 35 degrees, between 20 degrees and 35 degrees, or between 12 degrees and 30 degrees.

In embodiments where the golf club head comprises a fairway wood, the volume of the club head is less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In these embodiments, the volume of the club head can be approximately 160 cc-200 cc, approximately 160 cc-250 cc, approximately 160 cc-300 cc, approximately 160 cc-350 cc, approximately 160 cc-400 cc, approximately 300 cc-400 cc, approximately 325 cc-400 cc, approximately 350 cc-400 cc, approximately 250 cc-400 cc, approximately 250 cc-350 cc, or approximately 275 cc-375 cc.

D) Hybrid

In some embodiments, the golf club head can comprise a hybrid. In these embodiments, the loft angle of the club head can be less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in these embodiments, the loft angle of the club head can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

In embodiments where the golf club head comprises a hybrid, the volume of the club head is less than approximately 200 cc, less than approximately 175 cc, less than approximately 160 cc, less than approximately 125 cc, less than approximately 100 cc, or less than approximately 75 cc. In some embodiments, the volume of the club head can be approximately 100 cc-160 cc, approximately 75 cc-160 cc, approximately 100 cc-125 cc, or approximately 75 cc-125 cc.

In some embodiments, the golf club head 100 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In some embodiments, the strike face 108 of the golf club head 100 can comprise stainless steel, titanium, aluminum, a steel alloy (e.g. 455 steel, 475 steel, 431 steel, 17-4 stainless steel, maraging steel), a titanium alloy (e.g. Ti 7-4, Ti 6-4, T-9S), an aluminum alloy, or a composite material. In other embodiments, the golf club head 100 can comprise the same material as strike face 108. In some embodiments, the golf club head 100 can comprise a different material than strike face 108.

II) Weigh Assembly of Golf Club Head

FIGS. 1-7 illustrate an embodiment of a golf club head 100 having a variable weight assembly 380 (also referred to as a weight assembly).

Figure 4:
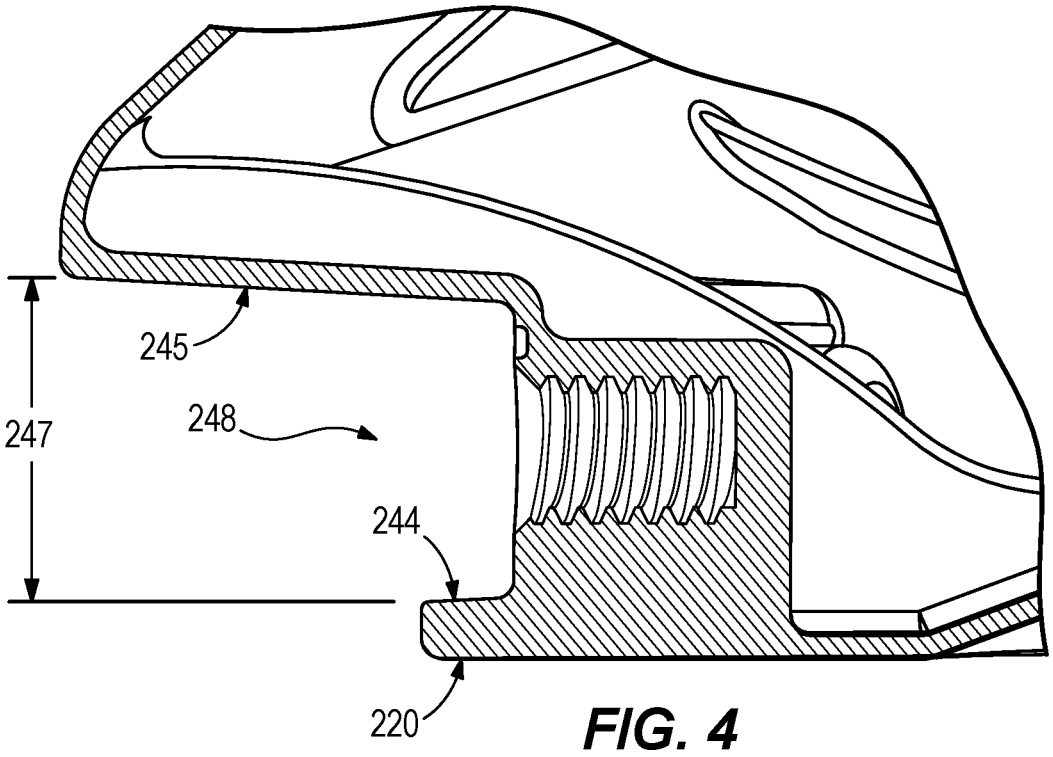
FIG. 4 illustrates a side cross-section of the weight assembly slot structure.
Figure 5:
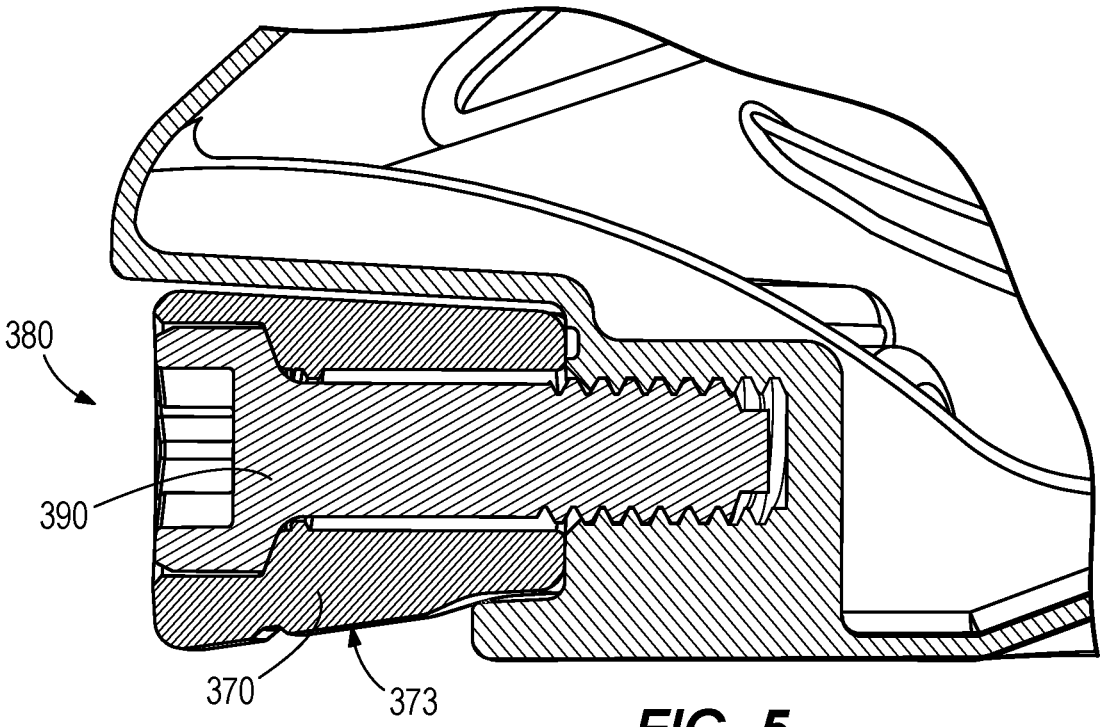
FIG. 5 illustrates a side cross-section of the weight assembly slot structure with variable weight assembly.
Figure 6:
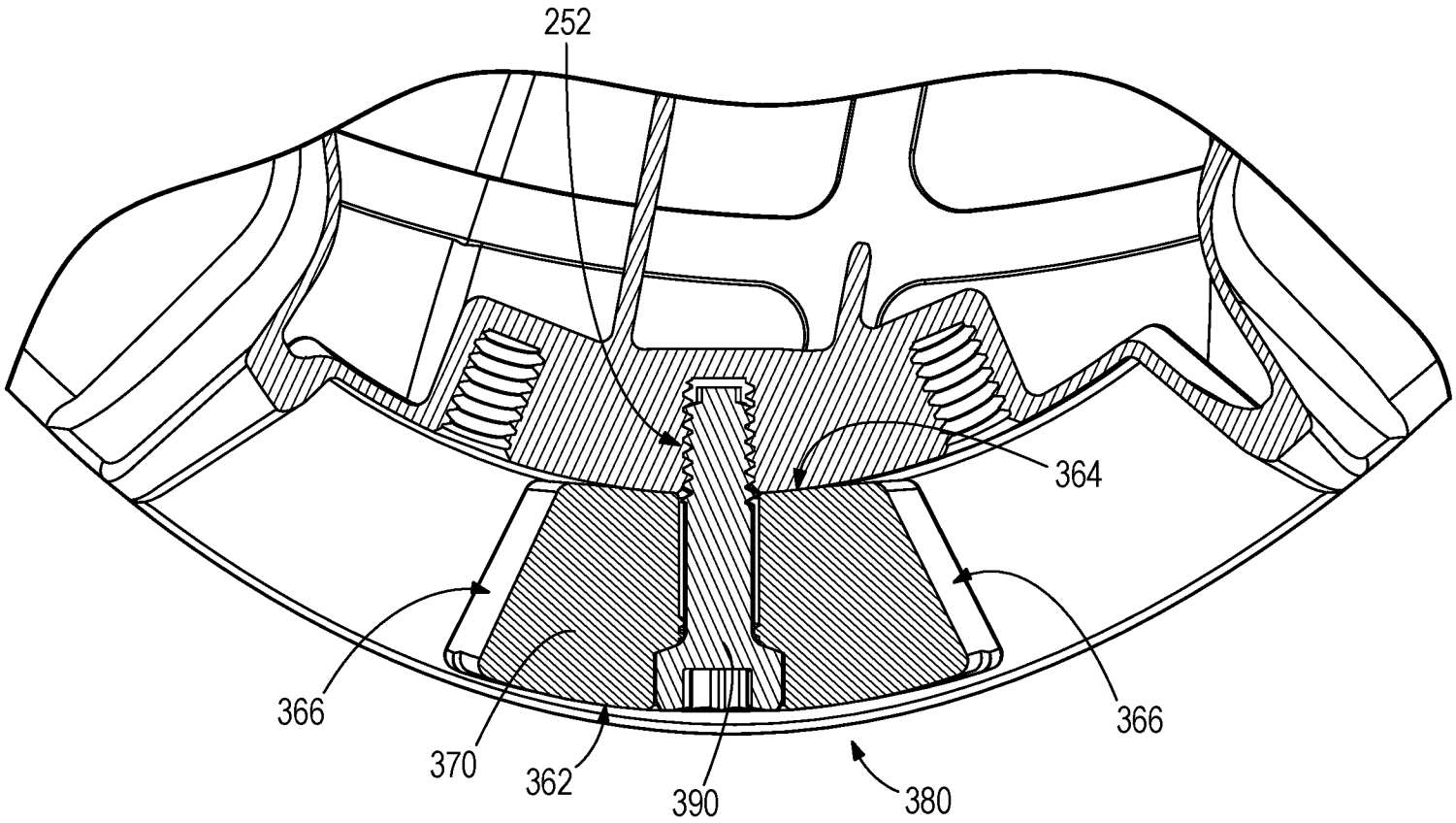
FIG. 6 illustrates a horizontal cross-section of the variable weight assembly.
Figure 7:
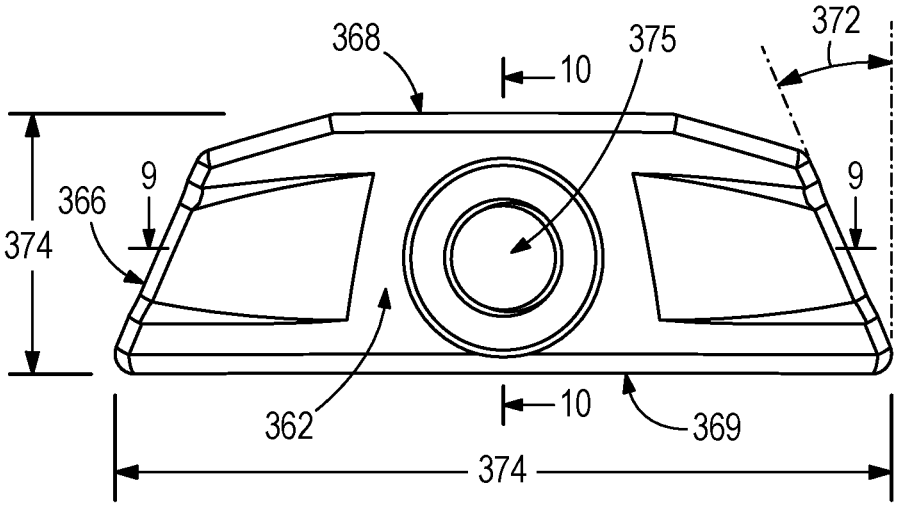
FIG. 7 illustrates a weight member outer surface view.
Figure 8:
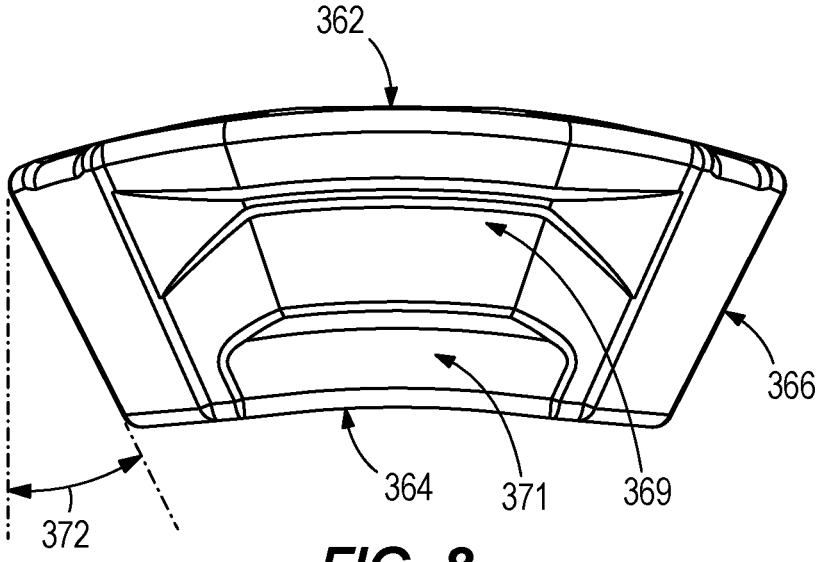
FIG. 8 illustrates a weight member lower surface view.

Referring to FIGS. 1, 2, and 4, the golf club head 100 as described above further comprises a single slot 240 in the rear portion of the sole 116, wherein the single slot 240 is the receiving geometry for the weight assembly 380. The golf club head 100 does not comprise a plurality of slots.

Referring to FIGS. 4, 5, 6, 7, and 16, the slot 240 in the sole 116 of the golf club head 100 comprises an slot interior surface 242, wherein the slot interior surface 242 is approximately perpendicular to the sole 116. The slot interior surface 242 comprises a slot length 257. The slot 240 comprises a slot bottom surface 244 that is perpendicular to the slot interior surface 242 and approximately parallel to the sole 116. The slot 240 comprises a top surface 245 that is perpendicular to the slot interior surface 242 and approximately parallel to the sole 116. The slot 240 bottom surface 244 does not extend as far towards the rear of the golf club head 100 as the slot top surface 245. The slot 240 further comprises two sidewalls 246. The two slot sidewalls 246 are at toeward and heelward ends of the slot interior surface 242. The slot interior surface 242, bottom surface 244, top surface 245, and two sidewalls 246 define a channel 248 open to the rear and bottom of the golf club head 100 such that when the slot 240 receives the weight assembly 380, at least a portion of the outer 362 and lower surfaces 369 of the weight assembly 380 are both exposed. The outer 362 and lower surfaces 369 of the weight assembly 380 are not concealed or entirely surrounded by the slot bottom surface 244.

The slot 240 may comprise two to six apertures. The slot 240 may comprise 2, 3, 4, 5, or 6 apertures. In most embodiments, the apertures are equally spaced, however in some embodiments, the apertures can be unevenly spaced across the interior surface 242 of the slot 240. In the exemplary embodiment, the slot 240 comprises three apertures spaced along the interior surface of the slot 242 such that each aperture center is spaced between 0.5 inch and 0.6 inch from the adjacent aperture(s).

The weight assembly 380 can be positioned and affixed within the single slot 240. The position of the weight assembly 380 within the single slot 240 determines the effect that the mass of the weight assembly 380 will have on the position of the total CG 180 of the golf club head 100. A movement of the weight assembly 380 toward the toe 124 or heel 120 of the golf club head 100 will move the CG 180, and will help shape the flight of a golf ball when it is struck with the golf club head 100.

The single slot 240 can further comprise at least a central aperture 252, a heel-side aperture 254, and a toe-side aperture 256. Each of the apertures comprise weight assembly 380 attachment points within the single slot 240. Each of the toe-side, central, and heel-side apertures comprise a circular cross section and an aperture center. Each of the toe-side, central, and heel-side apertures are threaded to receive a threaded fastener 390.

The golf club head 100 can further comprise a shroud 220, wherein the shroud 220 is a portion of the sole 116 of the golf club head 100 that can extend to span over the slot 240. The shroud 220 may comprise a portion or all of the bottom surface 244.

In most embodiments, the shape of the interior surface of the slot 242 is complimentary to the shape of the inner surface 364 of the weight member 370. In the exemplary embodiment, the interior surface of the slot 242 is convex and is complementary to the concave interior surface 364 of the weight member 370.

The slot length 257 of the slot interior surface 242 may vary between 1.6 inches and 2.0 inches. The slot length 257 may be 1.6 inches, 1.7 inches, 1.8 inches, 1.9 inches, or 2.0 inches. The slot length 257 of the slot interior surface 242 is no longer than 2.0 inches.

Further, in some embodiments, the slot 240 can comprise an asymmetric shape, wherein the cross-sectional shape of the slot 240 in a heel to toe direction is non-uniform. The shape of the slot 240 is imperative to the security of the weight assembly within the slot 240, since the asymmetric cross-sectional shape of the slot channel 248 enables three positions to align the weight assembly 380 with one of the heel-side 254, toe-side 256, or central 252 apertures. Due to the asymmetric shape of the slot 240 the weight assembly 380 is unable to slide throughout the channel 248. Rather, the weight assembly 380 must be removed and placed in one of the three distinct positions.

Furthermore, the slot 240 can comprise a height 247 measured from the bottom surface of the slot 244 to the sole 116. Wherein the height 247 of the slot 240 is the height of the channel 248. In most embodiments, the slot 240 can comprise a variable height 247, wherein the height is inconsistent in the heel to toe direction. The non-uniform height of the slot 240 is imperative to the security of the weight assembly 380 within the slot 240, since the variable height 247 of the channel 248 enables three positions to align the weight assembly 380 with one of the heel-side 254, toe-side 256, or central 252 apertures. Due to the non-uniform height 247 of the slot 240 the weight assembly 380 is unable to slide laterally throughout the channel 248. Rather, the weight assembly 380 must be removed and placed in one of the three distinct positions. This prevents the golfer from being provided unlimited position choices that create confusion in determining shot shape of the golf ball and flight.

The variable height 247 of the slot 240 may vary in a range between 0.2 and 0.6 inch. The variable height 247 of the slot 240 may be 0.2 inch, 0.3 inch, 0.4 inch, 0.5 inch, or 0.6 inch.

In some embodiments, the golf club head 100 can comprise a shroud 220, wherein a portion of the sole 116 of the golf club head can span over the slot 240. The shroud 220 functions to increase the aerodynamics of the channel 248 and assist in properly inserting the weight member 370 within the slot 240. The shroud 220 can have any desired geometry to cover a specific portion(s) of the slot or the entire slot 240. In some embodiments, the shroud 220 can cover 5%-10% of the slot, 10%-15% of the slot, 15%-20% of the slot, 20%-25% of the slot, 25%-30% of the slot, 30%-35% of the slot, 35%-40% of the slot, 40%-45% of the slot, 45%-50% of the slot, 50%-55% of the slot, 55%-60% of the slot, 60%-65% of the slot, 65%-70% of the slot, 70%-75% of the slot, 75%-80% of the slot, 80%-85% of the slot, 85%-90% of the slot, 90%-95% of the slot, or 95%-100% of the slot.

A) Weight Assembly

Referring to FIGS. 6, 7, and 12-14, the variable weight assembly 380 (also referred to as the weight assembly) comprises a single weight member 370 and a single mechanical fastener 390 (or fastener). The weight member 370 is configured to be positioned within the slot 240 of the golf club head 100. The weight member 370 comprises an outer surface 362, an inner surface 364, side walls 366 extending between the outer surface 362 and an interior surface 364, an upper surface 368, a lower surface 369, and an aperture 375 extending through the weight member 370 from the outer surface 362 to the inner surface 364. The aperture 375 further comprises an aperture thread 377 on an interior portion of the aperture 375. The fastener 390 is retained within the weight member 370 when the weight assembly 370 is detached from the slot 240 by means of the aperture thread 377 within the weight member aperture 375. The lower surface 369 of the weight member 370 further comprises an indent 371 configured to receive the slot bottom surface 244 formed by an extension of the sole 116. Wherein the extension of the sole 116 comprises the shroud 220. The shroud 220 provides additional stability to the weight assembly 380 when it is threadably affixed to the slot 240.

In some embodiments, more than one weight member 370 may be available to be affixed to the golf club head. Two weight members 370 may have different masses. However, only one weight assembly 380 may be affixed to the golf club head at a time. Two or more weight members 370 or two or more weight assemblies 380 may not be affixed to the golf club head at a time.

The weight member 370 can be made of any material, such as metals, polymers (e.g. thermoplastic polyurethane, thermoplastic elastomer), composites, or any combination thereof. The weight member 370 can be a polymer injection molded with different quantities of a high-density material (e.g. metal powder) or materials of different densities, to achieve backweights of varying mass, while maintaining the same volume. Injection molded weight members with different densities allow for a wide range of weight members with an identical volume and geometric shape.

In many embodiments, the mass of the weight member ranges between 14 g and 48 g. In some embodiments, the mass of the weight member ranges from 14 g-16 g. 16 g-18 g, 18 gr-20 gr, 20.0 g-22.0 g, 22.0 g-24.0 g, 24.0 g-26.0 g, 26.0 g-28.0 g, 28.0 g-30.0 g, 30.0 g-32.0 g, 32.0 g-34.0 g, 34.0 g-36.0 g, or 36.0 g-38.0 g. The mass of the weight assembly can be 14 g, 15, 16, 17, 18, 19, 20 g, 21 g, 22 g, 23 g, 24 g, 25 g, 26 g, 27 g, 28 g, 29 g, 30 g, 31 g, 32 g, 33 g, 34 g, 35 g, 36 g, 37 g, 38 g, 39 g, 40 g, 41 g, 42 g, 43 g, 44 g, 45 g, 46 g, 47 g, or 48 g. In many embodiments, the mass of the weight assembly (weight member and fastener) ranges between 16 grams and 50 grams. In some embodiments, the mass of the backweight assembly ranges from 16 g-18 g, 18 g-20 g, 20 g-22 g, 22.0 g-24.0 g, 24.0 g-26.0 g, 26.0 g-28.0 g, 28.0 g-30.0 g, 30.0 g-32.0 g, 32.0 g-34.0 g, 34.0 g-36.0 g, 36.0 g-38.0 g, or 38.0 g-40.0 g, 40 g-42 g, 42 g-44 g, 44 g-46 g, 46 g-48 g, or 48 g-50 g. The mass of the weight assembly can be 16 g, 17 g, 18 g, 19 g, 20 g, 21 g, 22 g, 23 g, 24 g, 25 g, 26 g, 27 g, 28 g, 29 g, 30 g, 31 g, 32 g, 33 g, 34 g, 35 g, 36 g, 37 g, 38 g, 39 g, 40 g, 41 g, 42 g, 43 g, 44 g, 45 g, 46 g, 47 g, 48 g, 49 g, or 50 g.

The weight member 370 may not have a mass less than 14 grams. The weight assembly may not have a weight assembly 380 mass less than 16 grams. A lower mass for the weight member 370 or weight assembly 380 will provide insufficient mass to affect golf club head performance in a meaningful manner given the restriction of movement the slot 240 size and location imposes on movement of the weight assembly 380.

Figure 9:
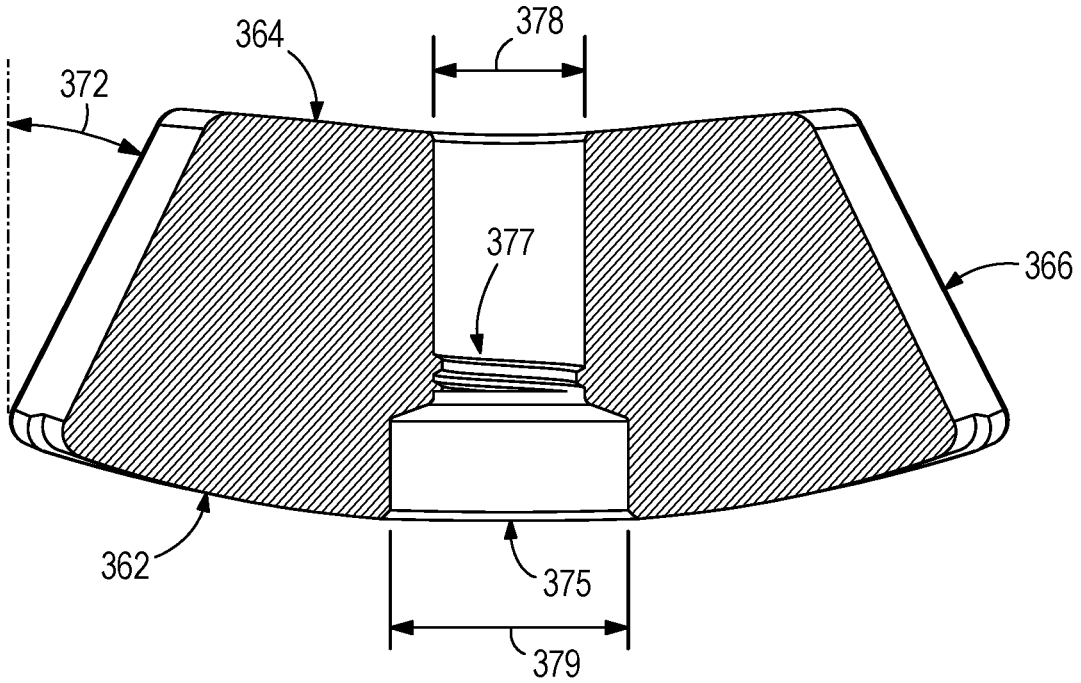
FIG. 9 illustrates a weight member horizontal cross-section.
Figure 10:
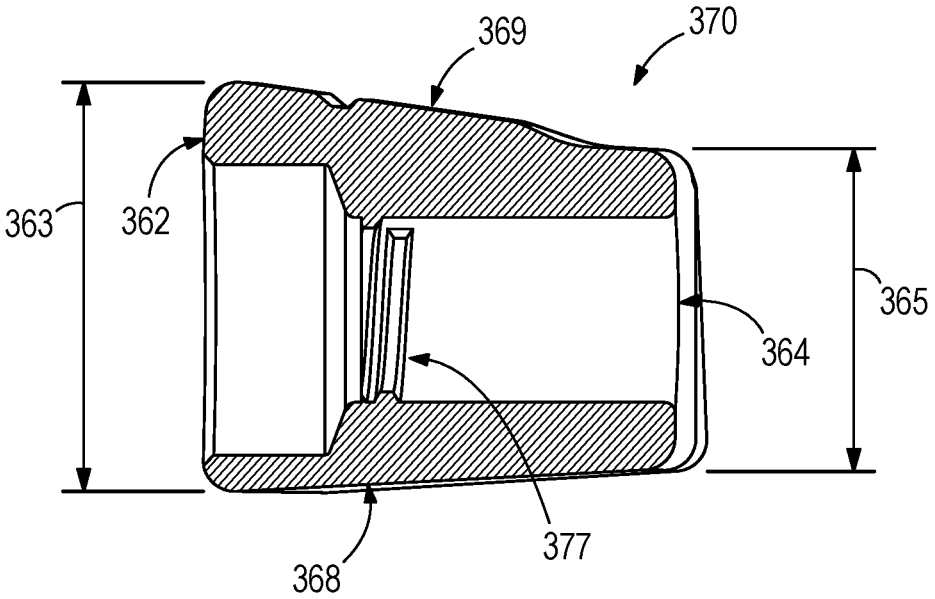
FIG. 10 illustrates a weight member vertical cross-section.
Figure 11:
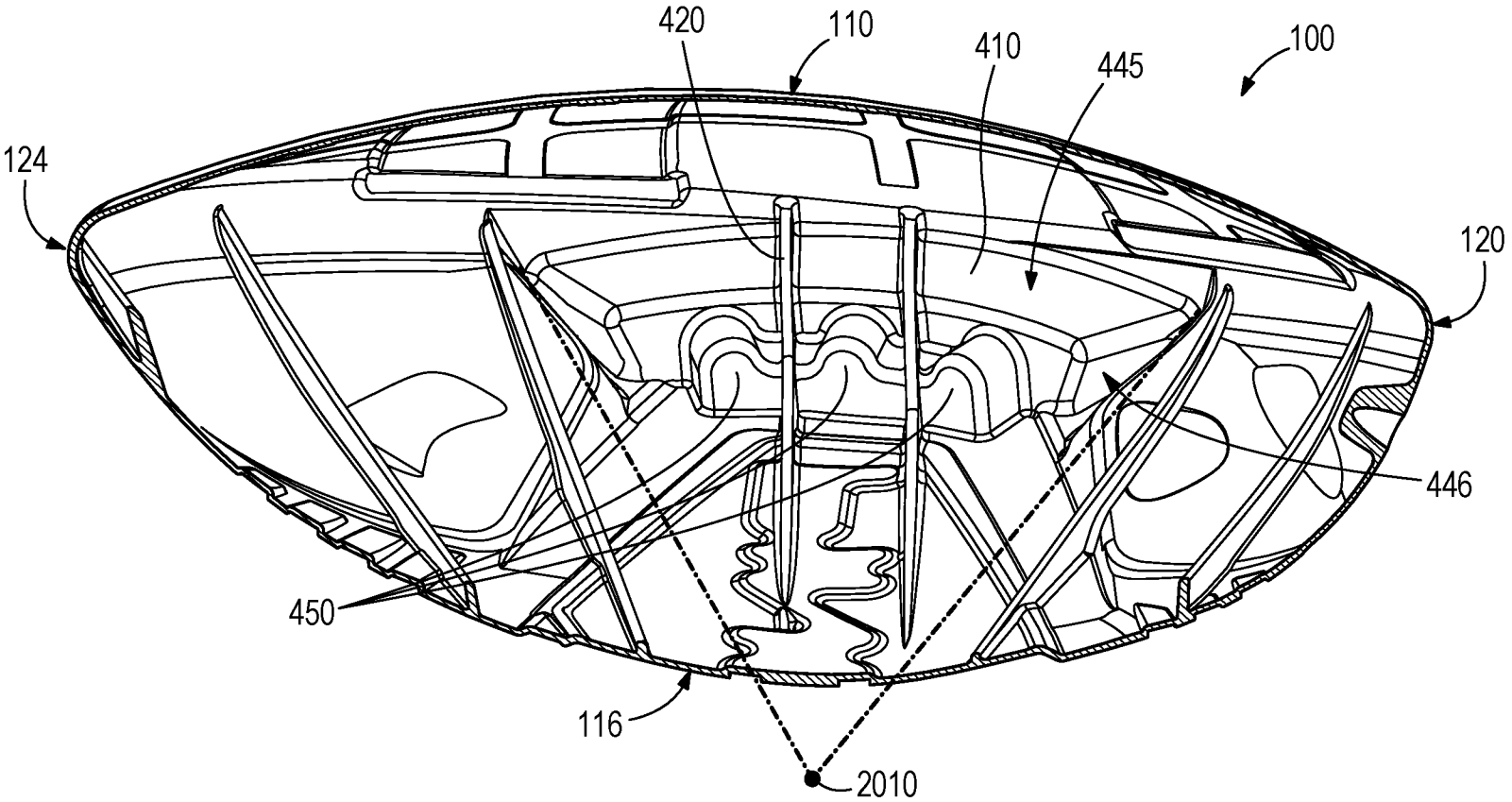
FIG. 11 illustrates a cut away view of a golf club rear portion interior surface.

Referring to FIGS. 9-11, in the illustrated embodiment, the weight member 370 comprises a generally rectangular shape. In other embodiments, the weight member can comprise any shape. For example, the shape of the weight member can comprise a circle, an ellipse, a triangle, a rectangle, an octagon, or any other polygon or shape comprising at least two curved surfaces.

The weight member 370 comprises a length 374 measured along in a toe to heel direction when the weight member 370 is affixed within the slot 240. The weight member 370 comprises a width 376 measured in a front to rear direction when the weight member 370 is affixed within the slot 240. The weight member 370 comprises a maximum outer surface height 363 measured in a sole to crown direction along a weight outer surface 362 when the weight member 370 is affixed within the slot 240. The weight member 370 comprises a maximum interior surface height 365 measured in a sole to crown direction along a weight interior surface 364 when the weight member 370 is affixed within the slot 240. The weight member 370 comprises a weight member center of gravity or CG 500. The weight member 370 is configured such that the weight member CG 500 is within the weight member aperture 375.

The weight member length 374 is measured in a toe to heel direction along the interior surface 364 of the weight member 370, The weight member length 374 may vary in range of 0.5 inch to 2.0 inch. The weight member length 374 may be 0.5 inch, 0.6 inch, 0.7 inch, 0.8 inch, 0.9 inch, 1.0 inch, 1.1 inches, 1.2 inches, 1.3 inches, 1.4 inches, 1.5 inches, 1.6 inches, 1.7 inches, 1.8 inches, 1.9 inches, or 2.0 inches. The weight member length 374 may not be greater than 2.0 inches.

The weight member width 376 may vary in a range of 0.4 inch to 2.0 inches. The weight member length 376 may be 0.4 inch, 0.5 inch, 0.6 inch, 0.7 inch, 0.8 inch, 0.9 inch, 1.0 inch, 1.1 inches, 1.2 inches, 1.3 inches, 1.4 inches, 1.5 inches, 1.6 inches, 1.7 inches, 1.8 inches, 1.9 inches, or 2.0 inches.

The weight member maximum outer surface height 363 may vary in a range of 0.2 inch to 0.6 inch. The maximum outer surface height 363 may be 0.2 inch, 0.3 inch, 0.4 inch, 0.5 inch, or 0.6 inch.

The weight member maximum interior surface height 365 may vary in a range of 0.1 inch to 0.5 inch. The interior surface height 365 may be 0.1 inch, 0.2 inch, 0.3 inch, 0.4 inch, or 0.5 inch.

When the weight assembly 380 is affixed to the golf club head 100, the weight member 370 slopes downward from the interior surface 364 towards the outer surface 362 such that more of the mass of the weight member 370 is distributed towards the rear portion 128 and sole 116 of the golf club head 100. This further contributes to the movement of the total CG 180 of the golf club head 100 rearwards and downwards.

The outer surface height 363 is greater than the inner surface height 365, which produces the downward sloping shape of the weight member 370. An lower surface slant or angle 373 is defined by the difference in the outer surface height 363 and the interior surface height 365. The lower surface angle 373 may vary in a range of 1 degree to 30 degrees. The lower surface angle 373 may be 1 degree, 2 degrees, 3 degrees, 4 degrees, 5 degrees, 6 degrees, 7 degrees, 8 degrees, 9 degrees, 10 degrees, 11 degrees, 12 degrees, 13 degrees, 14 degrees, 15 degrees, 16 degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees, 30 degrees.

The weight member 370 further comprises a sloping reduction of its maximum height towards each end along the length 374 of the weight member. The two sloping shoulders of the weight member's reduced height further assists in the retention of the weight member 370 within the slot 240. As the slot height 247 varies asymmetrically, the positions within the slot 240 wherein the weight member 370 may be affixed have a larger height. The sloping shoulders of the weight member 370 allow either end of the weight member 370 to fit within the slot 240 as the variable height 247 of the slot 240 decreases around the positions wherein the weight member 370 may be affixed. The sloping shoulders therefore contribute to the retention of the weight member 370 within the slot 240, and are configured to fit within the variable height 247 of the slot 240.

B) Adjustment of Weight Assembly

Figure 12:
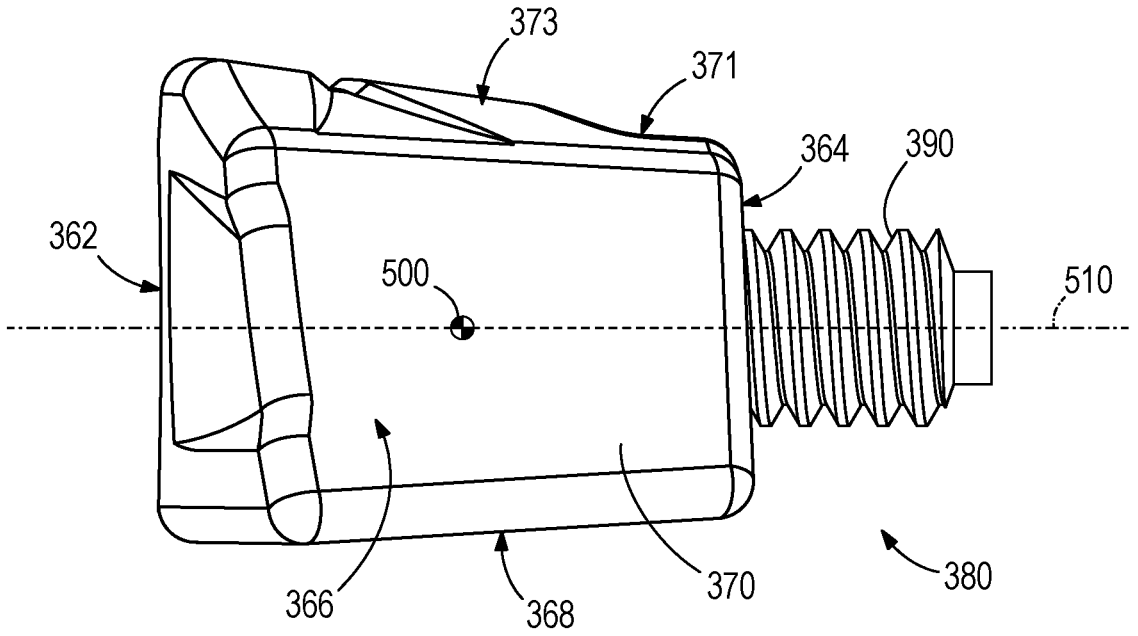
FIG. 12 illustrates a side view of a weight assembly.
Figure 13:
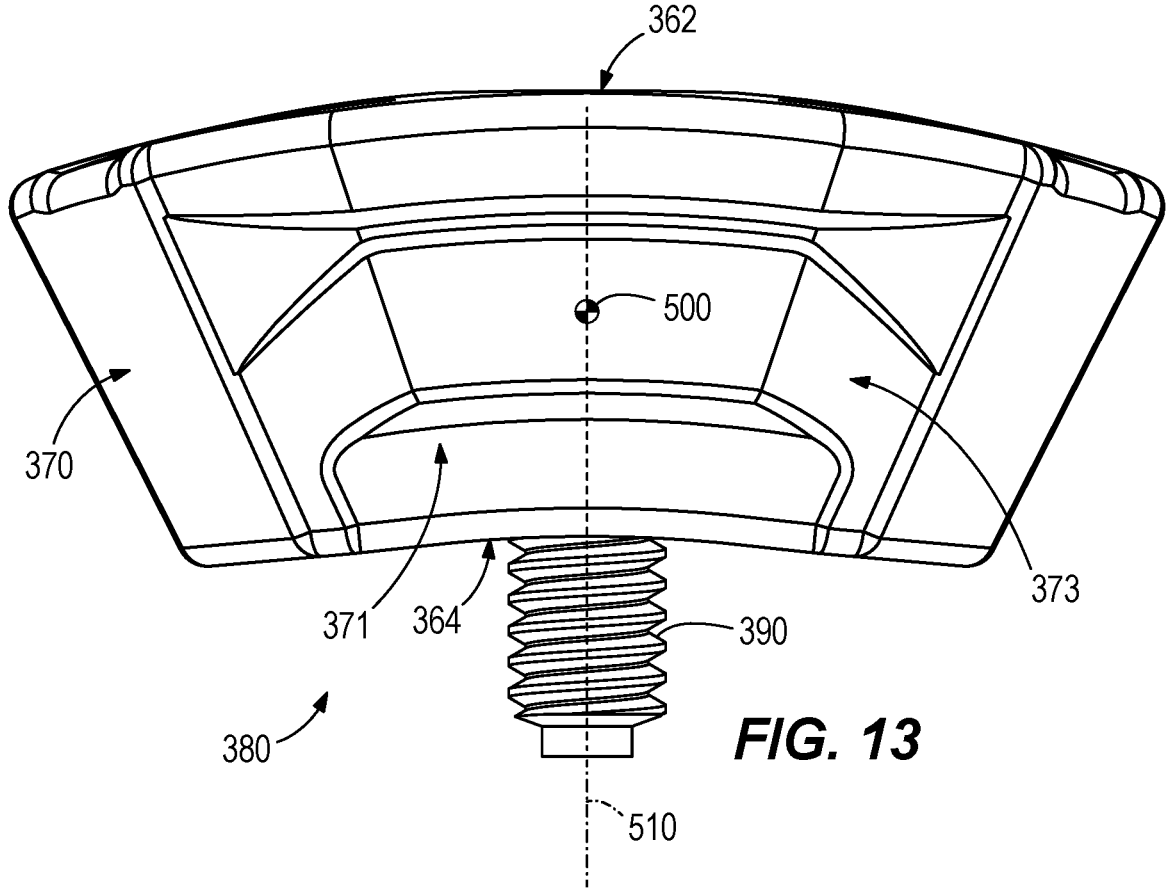
FIG. 13 illustrates a bottom view of a weight assembly.

Referring to FIGS. 12 and 13, when the weight assembly 380 is affixed to the golf club head 100 by threadably attaching the weight member 370 with fastener 390 to one of the heel-side, central, or toe-side threaded apertures, the weight assembly 380 comprises a fastener axis 510. The fastener axis 510 of the weight assembly 380 is an axis through a longitudinal center of the fastener 390 when the weight assembly 380 is affixed with fastener 390 to one of the heel-side, central, or toe-side threaded apertures. When the weight assembly 380 is affixed in the heel-side aperture 254, the fastener axis defines a heel-side fastener axis 512. When the weight assembly 380 is affixed in the central aperture 252, the fastener axis defines a central fastener axis 514. When the weight assembly 380 is affixed in the toe-side aperture 256, the fastener axis defines a toe-side fastener axis 516.

Because the interior surface of the slot 242 is convex, each of the toe-side fastener axis 516 and the heel-side fastener axis 512 extend in a line toward the golf club head front end 112 such that the extended axes come to a point of intersection. The point of intersection of the two axes comprises a depth from the loft plane 1010. The fastener axis intersection point depth 540 may vary between 2.8 inches and 3.2 inches. The fastener axis intersection point depth 540 may be 2.8 inches, 2.9 inches, 3.0 inches, 3.1 inches, or 3.2 inches.

The toe-side fastener axis 516 and heel-side fastener axis 512 form two rays of an angle having a vertex at the fastener axis intersection point 540. The size of the angle between the toe-side fastener axis 516 and heel-side fastener axis 512 comprises an angular separation between the two axes. Further, because toe-side and heel-side apertures are the apertures furthest apart within the slot, the two fasteners axes are at a maximum angular separation.

Figure 15:
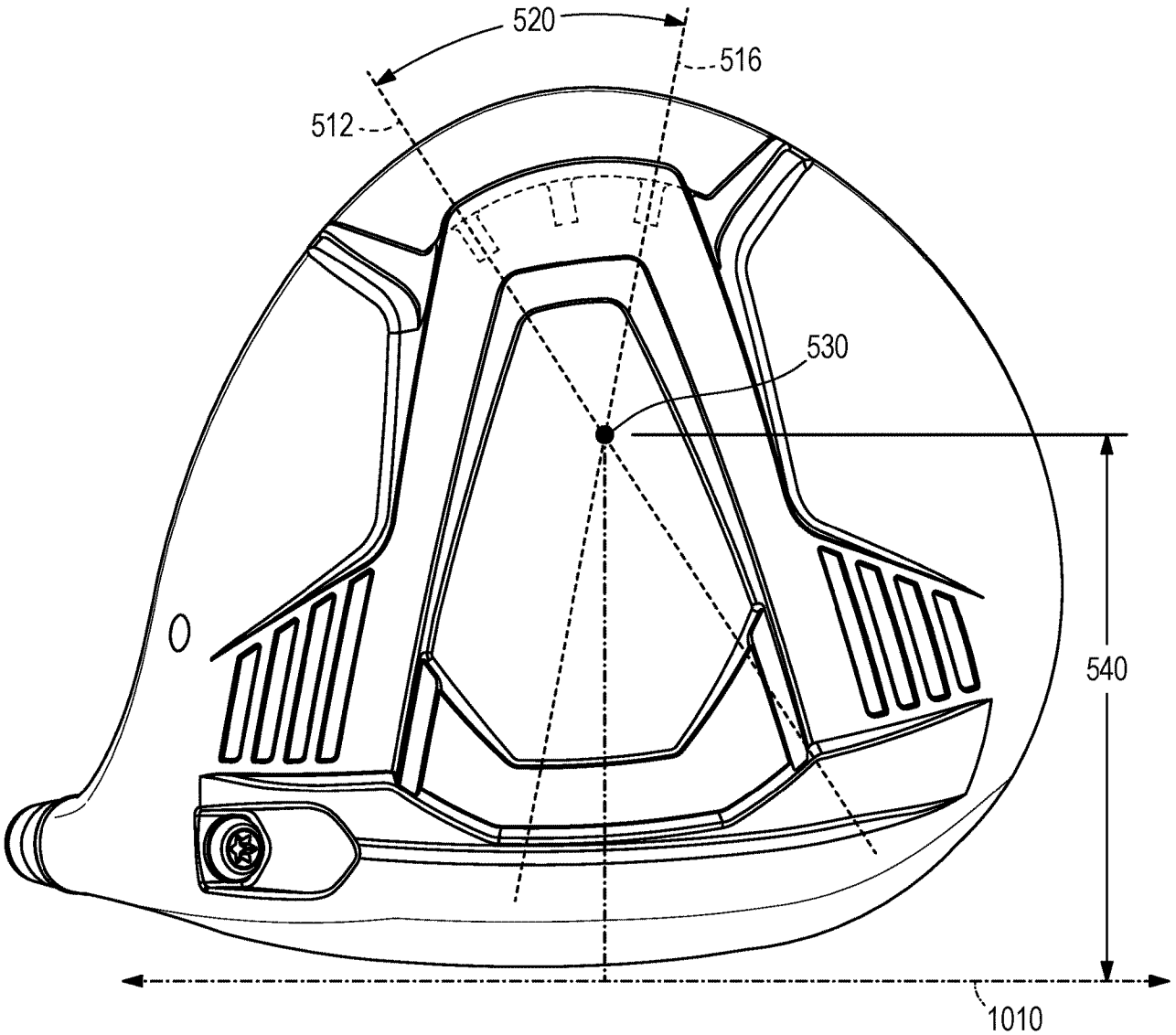
FIG. 15 illustrates a bottom view of a golf club head.
Figure 16:
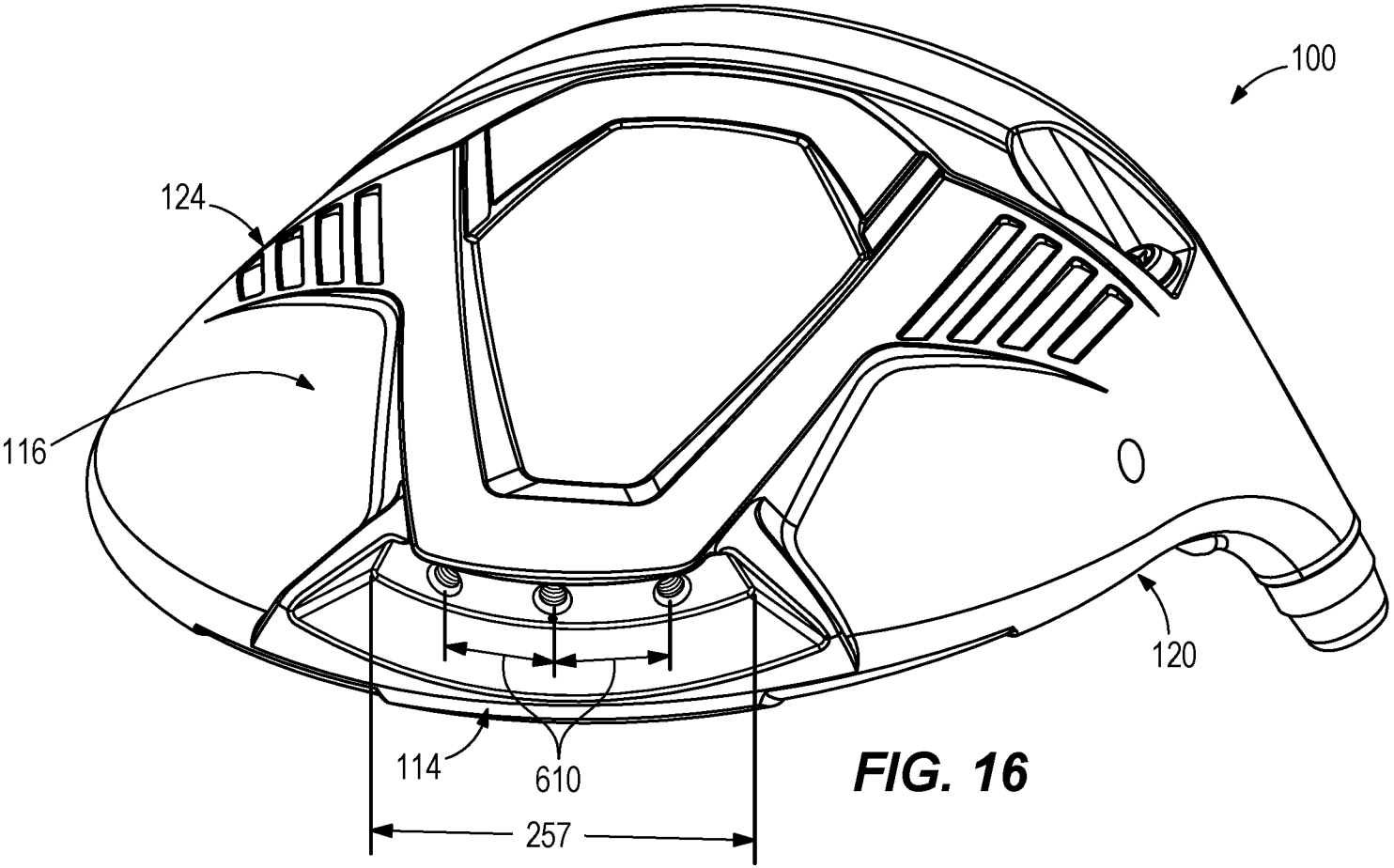
FIG. 16 illustrates a rear, bottom view of a golf club head.
Figure 17:
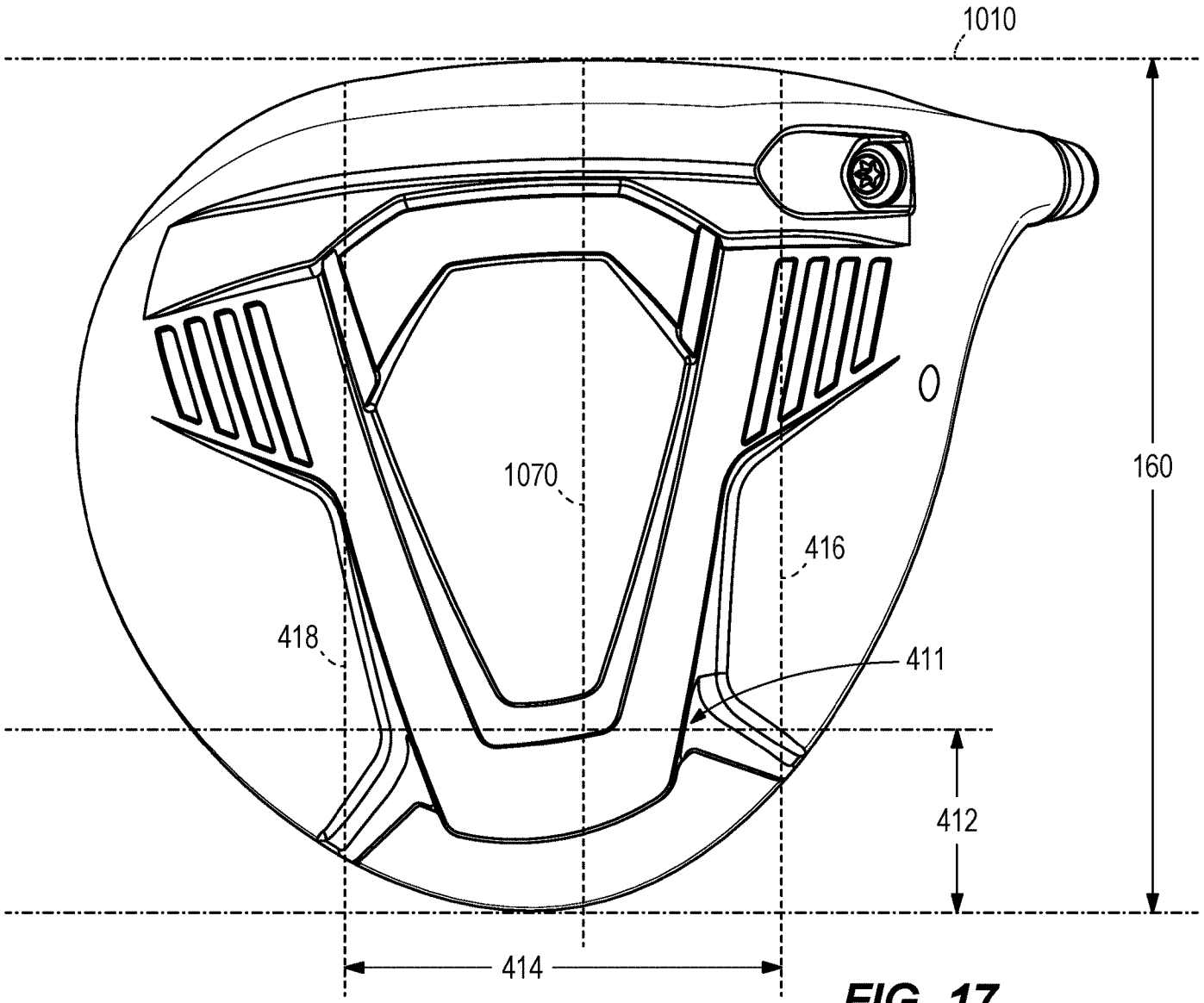
FIG. 17 illustrates a bottom view of a golf club head indicating a slot structure extent.

Referring to FIG. 15, in the exemplary golf club head, the toe-side aperture 256 and heel-side aperture 254 are the apertures that are farthest from one another within the slot 240. The maximum angular fastener axis separation 520 of the toe-side fastener axis 516 and the heel-side fastener axis 512 varies within a range of 40 degrees and 55 degrees. The maximum angular fastener axis separation 520 may be 40 degrees, 41 degrees, 42 degrees, 43 degrees, 44 degrees, 45 degrees, 46 degrees, 47 degrees, 48 degrees, 49 degrees, 50 degrees, 51 degrees, 52 degrees, 53 degrees, 54 degrees, or 55 degrees. In the exemplary golf club head, the maximum angular fastener axis separation 520 is approximately 45 degrees. The relatively small maximum angular fastener axis separation 520 of the toe-side fastener axis 516 and the heel-side fastener axis 512 further indicates the compactness of the slot and weight assembly variable weight system.

Alternately, the golf club head depth 160 is in a range of 3.0 inches to 6.0 inches. Referring to FIG. 15, a slot support structure depth 412 comprises the difference between the total depth 160 of the golf club head 100 and the distance from the loft plane 1010 to the forward most portion 411 of the slot support structure 410. A line parallel to the Z-axis 1070 tangent to the most heel-ward portion of the slot structure 410 is the heel-ward boundary 416 of the slot structure 410. A line parallel to the Z-axis 1070 tangent to the most toe-ward portion of the slot structure 410 is the toe-ward boundary 418 of the slot structure 410. The distance between the heel-ward boundary 416 and the toe-ward boundary 418 is the slot structure length 414.

The slot structure depth 412 may vary in a range from 0.9 inch to 1.2 inches. The slot structure length 414 may vary in a range from 2.2 inches to 2.8 inches.

The slot structure depth 412 may be 0.9 inch, 1.0 inch, 1.1 inches, or 1.2 inches.

The slot structure length 414 may be 2.2 inches, 2.3 inches, 2.4 inches, 2.5 inches, 2.6 inches, 2.7 inches, or 2.8 inches.

The slot structure depth 412 may not be greater than 1.2 inches. The slot structure length 414 may not be greater than 2.8 inches.

Due to the limited size of the slot structure 240, the mass of the slot structure 240 is very small in comparison to the total mass of the golf club head 100. The mass of the slot structure 240 may be less than 7.0% of the total mass of the golf club head 100.

Referring to FIG. 11, the slot support structure 410 further comprises a rib or ribs 420. The rib or ribs 420 are within the hollow, interior of the golf club head 100, and not visible from the exterior of the golf club head 100. The rib or ribs 420 protrude from and are integrally attached to the interior surface of the slot support structure 410 and the sole 116. The rib or ribs 420 are not attached to or protruding from any of the slot aperture housings 450. The rib or ribs 420 may also buttress the slot structure to prevent oscillation of the slot structure during a golf club head impact of with a golf ball, given the high mass of the weight assembly affixed within the slot 240. It is understood that the golf club head 100 is not limited to one support rib and may comprise a plurality of ribs 420. The illustrated embodiments depict a generally planar rib 420 that extends in a front to rear direction. The rib or ribs 420 may have a geometry defined by a plurality of end points and edges.

Figure 14:
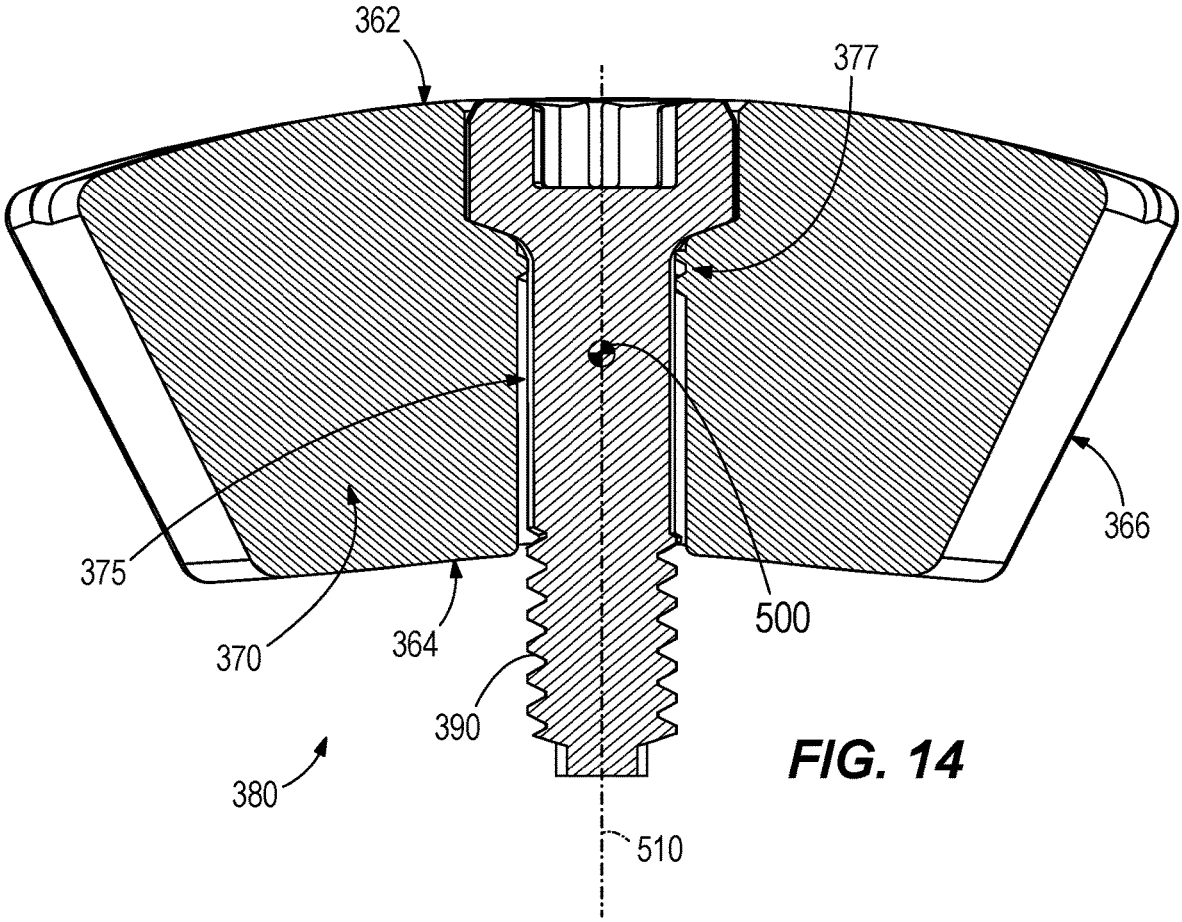
FIG. 14 illustrates a horizontal cross-section of a weight assembly.

Referring to FIGS. 13 and 14, the weight member center of gravity or CG 500 is located on the fastener axis 510 of the weight assembly 380. Thus, when the weight assembly 380 is affixed at the apertures that are farthest from one another within the slot 240 (the toe-side aperture 256 and heel-side aperture 254) the weight member center of gravity or CG 500 at each position is also separated by the maximum angular fastener axis separation 520.

C) Effects of Weight Assembly Displacement

The weight assembly 380 is moveable to each of the slot apertures. Each of the slot apertures is separated from the adjacent aperture(s) by an aperture separation distance 610. The aperture separation distance 610 may vary in a range from 0.5 inch to 0.6 inch. The aperture separation distance 610 may be 0.5 inch or 0.6 inch. In the exemplary embodiment, the aperture separation distance 610 is 0.6 inch. Moving the weight assembly from a central aperture position 252 to either the toe-side aperture 256 or heel-side aperture 254 moves the large mass of the weight assembly 380 such that the overall CG 180 of the golf club head 100 is displaced.

In one embodiment, the weight assembly 380 can be configured in the slot 240 of the golf club head 100 to set up in a neutral position to hit a straight golf shot. The fastener 390 affixes within the central aperture 252 of the slot 240. The central positioning of the weight member 370 within the slot 240 leads to a generally straight ball flight, as the center of gravity or CG 180 of the entire golf club head 100 is extremely balanced.

In another embodiment, the weight assembly 380 can be configured in the slot 240 of the golf club head 100, to set up a heel-ward position, to hit a fade type golf shot. The fastener 390 affixes within the heel-side aperture 254 of the slot 240. The heel-ward positioning of the weight member 370 within the slot 240 leads to a generally left to right ball flight (for lefthanded golfers a right to left ball flight), as the entire golf club head CG 180 is off center towards the heel portion 120, 320 of the golf club head 100.

In another embodiment, the weight assembly 380 can be configured in the slot 240 of the golf club head 100, to set up a toe-ward position, to hit a draw type golf shot. The fastener 390 affixes within the toe-side aperture 256 of the slot 240. The toe-ward positioning of the weight member 370 within the slot 240 leads to a generally right to left ball flight (for righthanded golfers a left to right ball flight), as the entire golf club head CG 180 is off center towards the toe portion 124, 324 of the golf club head 100.

Table 1 below displays the positioning of the CG 180 of the golf club head, as the weight assembly 380 is reconfigured within the slot 240. The golf club head CG 180 is displace in terms of movement parallel to the X-axis 1050, the Y-axis 1060, and the Z-axis 1070. The CG 180 differential movement in inches parallel to the X-axis is the CGx 185, the differential movement in inches parallel to the Y-axis is the CGy 186, and the differential movement in inches relative to the Z-axis is the CGz 187. The results below were compiled from a 35 gram tungsten weight, a 199 g golf club head weight, and with 0.6 inches of reconfiguration (or aperture separation distance 610) within the slot 240 relative to the central aperture 252 when the weight assembly 380 is moved to either the heel-side aperture 254 or the toe-side aperture 256.

TABLE 1

CG position with Weight Assembly Movement

| Weight Member Position | CGx | CGy | CGz |
|---|---|---|---|
| Heelward | 0.068 | 0.829 | −2.003 |
| Center | −0.027 | 0.835 | −2.041 |
| Toeward | −0.122 | 0.841 | −2.041 |

Referring to Table 1, above, the movement of CGx is approximately 0.04 inch towards the heel or 0.09 inch towards the toe from the starting center position when the weight member 370 is placed in either the heel-side aperture 254 or the toe-side aperture 256. However, the movements of CGy and CGz are significantly smaller (less than 0.01 inch and 0.04 inch respectively). Further, the total moment of inertia or MOI decrease of the golf club head 100 is minimized.

TABLE 2

MOI change with Weight Assembly Movement

| Weight Member Position | % Change of Combined Club Head MOI |
|---|---|
| Heelward | −3.4% |
| Center | |
| Toeward | 1.7% |

Referring to Table 2, above, the change of total MOI for the same golf club head 100 is a very small 3.4% decrease when the weight assembly 380 is shifted to the heel-side aperture 254, and the total golf club head MOI actually increases by 1.7% when the weight assembly is shifted to the toe-side aperture 256. Thus, as the CG 180 of the golf club head 100 is moved in a heelward or toeward direction, the forgiveness of the golf club head 100 is largely preserved.

TABLE 3

| MOI change with Weight Assembly Movement -Prior Art | |
|---|---|
| Weight Member Position | % Change of Combined Club Head MOI |
| Heelward | −11.0% |
| Center | |
| Toeward | −3.4% |

Referring to Table 3, above, a comparison of a similar, prior art golf club head has an 11.0% decrease in total golf club head MOI when the weight assembly is moved to a most heelward position, and 3.4% decrease when the weight assembly is moved to a most toeward position.

Moving the CG 180 of the exemplary golf club head 100 toward the heel 120 or toe 124 of the golf club head 100 contributes to shaping golf ball flight towards a fade or draw bias. Such shot shaping is desirable to help improve a golfer's shot. However, if an adjustable weight system requires a comparatively large movement of the adjustable weight across the volume of the golf club head, then the CG of the golf club head is moved forwards towards the striking face of the golf club head, and usually moved higher above the sole in the volume of the golf club head. This movement of the CG towards the striking face and higher in the club head volume reduces the combined or total moment of inertia of the golf club head. The reduction of total club head MOI is not desirable, as the forgiveness for off center hits is reduced. Thus, in golf club head having a conventional adjustable weight system, as illustrated in Table 3, the user must choose between shot shaping and forgiveness. Further, in conventional adjustable weight systems, the larger or more distributed weight port structures are permanently placed masses that often offset the effect of the movement of an adjustable weight member to other positions on a golf club head.

The weight assembly slot 240 described herein comprises three threaded receivers positioned relatively close to one another. The weight member 370 can be positioned in three different positions within the slot 240, to influence a straight ball flight, a right to left ball flight, and a left to right ball flight. The combination of a single, smaller slot 240 in the rear portion 128 with a single, heavy weight member 370 leads to improvements in CG movement and MOI preservation. This is achieved by confining the slot 240 to a relatively small arc on the rear 128 of the golf club head 100. The smaller maximum angular fastener axis separation 520 provides a smaller displacement of the weight member 370 towards the heel 120 or toe 124 of the golf club head 100, but the heavier weight member 370 counter balances the smaller maximum angular fastener axis separation 520 of the weight member 370, allowing the user to shape golf ball flight by using a comparatively smaller weight member displacement while also preserving more of the total MOI and forgiveness of the golf club head 100.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

The above examples may be described in connection with a wood-type golf club, the apparatus, methods, and articles of manufacture described herein. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:

a crown, a sole, a toe region, a heel region, a rear portion, and a front portion comprising a strike face;

wherein the crown, sole, toe-region, heel region, front portion, and rear portion form a hollow interior;

wherein the strike face further comprises a strike face geometric center;

wherein a loft plane is defined tangent to the strike face geometric center;

defining a coordinate system having an x-axis, y-axis, and z-axis through a coordinate system origin at the strike face geometric center;

wherein the x-axis extends through the strike face geometric center from the toe-region to the heel-region, the y-axis extends through the strike face geometric center in a direction from the crown to the sole, and the z-axis extends through the strike face geometric center in a direction from the front portion to the rear portion;

wherein the x-axis, y-axis, and z-axis are perpendicular to one another;

wherein the golf club head further comprises a depth measured from the loft plane to the rear most point of the rear portion parallel to the z-axis, and a length measured across the maximum extent between the toe-region to the heel-region parallel to the x-axis;

wherein in the rear portion further comprises a single slot; wherein the single slot comprises:

a slot interior surface, a slot bottom surface, a slot top surface, and two slot sidewalls;

wherein the slot interior surface, slot bottom surface, slot top surface, and two slot sidewalls cooperate to form a slot channel open to the rear and sole of the golf club head;

wherein the slot interior surface, slot bottom surface, slot top surface, and two slot sidewalls further form a slot structure exposed to the hollow interior;

wherein the slot interior surface further comprises a plurality of apertures;

wherein each of the plurality of apertures comprise weight assembly attachment points;

wherein the golf club head further comprises a moveable weight assembly;

wherein the weight assembly comprises a single weight member and a single fastener;

wherein the weight assembly may be detachably affixed to each of the plurality of apertures;

wherein the slot further comprises a slot height measured between the slot bottom surface and the slot top surface; and wherein the slot comprises a slot length measured between the two slot sidewalls; and wherein the slot height is varied along the slot length.

2. The golf club head of claim 1 wherein;

the weight member comprises a weight member through aperture;

the weight member comprises a weight member center of gravity or CG;

wherein the weight member CG is within the weight member aperture;

wherein the single fastener is received through the weight member aperture; and wherein the weight assembly comprises a fastener axis through the length of the single fastener.

3. The golf club head of claim 1 wherein;

the weight assembly has a mass in the range of 16 grams to 50 grams.

4. The golf club head of claim 1 wherein;

the plurality of apertures comprise three apertures;

wherein the three apertures are a toe-side aperture, a central aperture, and a heel-side aperture;

wherein the plurality of apertures are weight assembly attachment points.

5. The golf club head of claim 4 wherein;

when the weight assembly is affixed to the toe side aperture, the weight assembly comprises a toe-side fastener axis;

when the weight assembly is affixed to the central aperture, the weight assembly comprises a central fastener axis;

when the weight assembly is affixed to the heel side aperture, the weight assembly comprises a heel-side fastener axis.

6. The golf club head of claim 5 wherein;

wherein the toe-side fastener axis and the heel-side fastener axis extend such that they define a point of intersection;

the toe-side fastener axis and the heel-side fastener axis comprise an angle of separation between them with the point of intersection as the vertex of the angle;

wherein the angle of separation is in a range of 40 degrees to 50 degrees.

7. The golf club head of claim 1 wherein;

the weight member comprises:

an interior surface configured to conform to the slot interior surface;

an outer surface;

an upper surface;

a lower surface; and weight member sidewalls;

wherein the weight assembly is configured to detachably affix to the slot at each of the plurality of apertures such that the weight member outer surface is exposed at the rear portion, and the weight member lower surface is at least partially exposed at the sole.

8. The golf club head of claim 6 wherein;

the point of intersection defines a point of intersection depth measured from the loft plane towards the rear portion parallel to the z-axis;

wherein the point of intersection depth is in a range of 2.8 inches and 3.2 inches.

9. The golf club head of claim 1 wherein;

the slot structure comprises a most forward portion, a most toe-ward portion, and a most heel-ward portion;

wherein a slot structure depth is defined as the difference between the golf club depth and a distance between the slot structure most forward portion and the loft plane;

wherein the slot structure depth is in a range of 0.9 inch to 1.2 inches;

wherein a slot structure toe-ward boundary is defined as a line parallel to the z-axis and tangent to the slot structure most toe-ward portion, and a slot structure heel-ward boundary is defined as a line parallel to the z-axis and tangent to the slot structure most heel-ward portion;

wherein a slot structure length is defined as a distance between the slot structure toe-ward boundary and the slot structure heel-ward boundary;

wherein the slot structure length is in a range of 2.2 inches to 2.8 inches.

10. The golf club head of claim 1 wherein;

a rearward extension of the sole comprises a shroud;

wherein the shroud comprises at least a portion of the slot bottom surface.

11. The golf club head of claim 7 wherein;

the weight member lower surface comprises an indent configured to receive the slot bottom surface.

12. The golf club head of claim 1 wherein;

the slot height varies such that a cross-sectional shape of the weight assembly is asymmetric such that the weight assembly may not slide along the slot channel, but must be detached from the golf club head in order to be reattached to the golf club head in a different position.

13. The golf club head of claim 1 wherein;

the slot structure mass is less than 7.0% of a total mass of the golf club head.

14. A golf club head comprising:

a crown, a sole, a toe region, a heel region, a rear portion, and a front portion comprising a strike face;

wherein the crown, sole, toe-region, heel region, front portion, and rear portion form a hollow interior;

wherein the strike face further comprises a strike face geometric center;

wherein a loft plane is defined tangent to the strike face geometric center;

defining a coordinate system having an x-axis, y-axis, and z-axis through a coordinate system origin at the strike face geometric center;

wherein the x-axis extends through the strike face geometric center from the toe-region to the heel-region, the y-axis extends through the strike face geometric center in a direction from the crown to the sole, and the z-axis extends through the strike face geometric center in a direction from the front portion to the rear portion;

wherein the x-axis, y-axis, and z-axis are perpendicular to one another;

wherein the golf club head further comprises a depth measured from the loft plane to the rear most point of the rear portion parallel to the z-axis, and a length measured across the maximum extent between the toe-region to the heel-region parallel to the x-axis;

wherein in the rear portion further comprises a single slot; wherein the single slot comprises:

a slot interior surface, a slot bottom surface, a slot top surface, and two slot sidewalls;

wherein the slot interior surface, slot bottom surface, slot top surface, and two slot sidewalls cooperate to form a slot channel open to the rear and sole of the golf club head;

wherein the slot interior surface further comprises a plurality of apertures;

wherein each of the plurality of apertures comprise weight assembly attachment points;

wherein the golf club head further comprises a moveable weight assembly;

wherein the weight assembly comprises a single weight member and a single fastener;

wherein the weight assembly may be detachably affixed to each of the plurality of apertures;

wherein the slot further comprises a slot height measured between the slot bottom surface and the slot top surface; and wherein the slot comprises a slot length measured between the two slot sidewalls; and wherein the slot height is varied along the slot length.

15. The golf club head of claim 14 wherein;

the slot interior surface, slot bottom surface, slot top surface, and two slot sidewalls further form a slot structure exposed to the hollow interior.

16. The golf club head of claim 15 wherein;

the slot structure comprises a most forward portion, a most toe-ward portion, and a most heel-ward portion;

wherein a slot structure depth is defined as the difference between the golf club depth and a distance between the slot structure most forward portion and the loft plane;

wherein the slot structure depth is in a range of 0.9 inch to 1.2 inches;

wherein a slot structure toe-ward boundary is defined as a line parallel to the z-axis and tangent to the slot structure most toe-ward portion, and a slot structure heel-ward boundary is defined as a line parallel to the z-axis and tangent to the slot structure most heel-ward portion;

wherein a slot structure length is defined as a distance between the slot structure toe-ward boundary and the slot structure heel-ward boundary;

wherein the slot structure length is in a range of 2.2 inches to 2.8 inches.

17. A golf club head comprising:

a crown, a sole, a toe region, a heel region, a rear portion, and a front portion comprising a strike face;

wherein the crown, sole, toe-region, heel region, front portion, and rear portion form a hollow interior;

wherein the strike face further comprises a strike face geometric center;

wherein a loft plane is defined tangent to the strike face geometric center;

defining a coordinate system having an x-axis, y-axis, and z-axis through a coordinate system origin at the strike face geometric center;

wherein the x-axis extends through the strike face geometric center from the toe-region to the heel-region, the y-axis extends through the strike face geometric center in a direction from the crown to the sole, and the z-axis extends through the strike face geometric center in a direction from the front portion to the rear portion;

wherein the x-axis, y-axis, and z-axis are perpendicular to one another;

wherein the golf club head further comprises a depth measured from the loft plane to the rear most point of the rear portion parallel to the z-axis, and a length measured across the maximum extent between the toe-region to the heel-region parallel to the x-axis;

wherein in the rear portion further comprises a single slot; wherein the single slot comprises:

a slot interior surface, a slot bottom surface, a slot top surface, and two slot sidewalls;

wherein the slot interior surface, slot bottom surface, slot top surface, and two slot sidewalls cooperate to form a slot channel open to the rear and sole of the golf club head;

wherein the slot interior surface, slot bottom surface, slot top surface, and two slot sidewalls further form a slot structure exposed to the hollow interior;

wherein the slot interior surface further comprises a plurality of apertures;

wherein each of the plurality of apertures comprise weight assembly attachment points;

wherein the golf club head further comprises a moveable weight assembly;

wherein the weight assembly comprises a single weight member and a single fastener;

wherein the weight assembly may be detachably affixed to each of the plurality of apertures;

wherein;

the weight member comprises a weight member through aperture;

the weight member comprises a weight member center of gravity or CG;

wherein the weight member CG is within the weight member aperture;

wherein the single fastener is received through the weight member aperture; and wherein the weight assembly comprises a fastener axis through the length of the single fastener wherein a toe-side fastener axis and a heel-side fastener axis extend such that they define a point of intersection; wherein;

when the weight assembly is affixed to the toe side aperture, the weight assembly comprises the toe-side fastener axis;

when the weight assembly is affixed to the central aperture, the weight assembly comprises a central fastener axis;

when the weight assembly is affixed to a heel-side aperture, the weight assembly comprises the heel-side fastener axis;

wherein the toe-side fastener axis and the heel-side fastener axis comprise an angle of separation between them with the point of intersection as the vertex of the angle;

wherein the angle of separation is in a range of 40 degrees to 50 degrees;

wherein the slot further comprises a slot height measured between the slot bottom surface and the slot top surface; and wherein the slot comprises a slot length measured between the two slot sidewalls; and wherein the slot height is varied along the slot length.

18. The golf club head of claim 17 wherein;

a slot structure mass is less than 7.0% of a total mass of the golf club head.

* * * * *